US005521058A

United States Patent [19]

Yoshioka et al.

[11] Patent Number: 5,521,058

[45] Date of Patent: May 28, 1996

[54] SILVER HALIDE PHOTOGRAPHIC LIGHT-SENSITIVE MATERIAL

[75] Inventors: Yasuhiro Yoshioka; Hidetoshi Kobayashi, both of Minami-ashigara, Japan

[73] Assignee: Fuji Photo Film Co., Ltd., Kanagawa, Japan

[21] Appl. No.: 377,239

[22] Filed: Jan. 24, 1995

Related U.S. Application Data

[62] Division of Ser. No. 871,762, Apr. 17, 1992, Pat. No. 5,418,121.

[30] Foreign Application Priority Data

Apr. 19, 1991 [JP] Japan ..... 3-116978
Nov. 12, 1991 [JP] Japan ..... 3-322358

[51] Int. Cl.[6] ..... G03C 7/36; G03C 7/388

[52] U.S. Cl. ..... 430/546; 430/551; 430/556; 430/557

[58] Field of Search ..... 430/546, 551, 430/556, 557

[56] References Cited

U.S. PATENT DOCUMENTS

| | | | |
|---|---|---|---|
| 4,193,802 | 3/1980 | Mukunoki et al. | 430/546 |
| 4,239,851 | 12/1980 | Auki et al. | 430/546 |
| 4,252,894 | 2/1981 | Uiro et al. | 430/546 |
| 4,540,657 | 9/1985 | Krishnamurthy | 430/546 |
| 4,547,459 | 10/1985 | Kamio et al. | 430/546 |
| 4,745,049 | 5/1988 | Ohbayashi et al. | 430/546 |
| 4,767,697 | 8/1988 | Umemoto et al. | 430/546 |
| 4,794,072 | 12/1988 | Goddard | 430/546 |
| 4,923,783 | 5/1990 | Kobayashi et al. | 430/546 |
| 4,935,321 | 6/1990 | Merkel | 430/546 |
| 5,001,045 | 3/1991 | Fututachi et al. | 430/546 |
| 5,008,179 | 4/1991 | Chari et al. | 430/546 |
| 5,118,599 | 6/1992 | Lau et al. | 430/557 |
| 5,183,731 | 2/1993 | Takahashi et al. | 430/557 |
| 5,188,926 | 2/1993 | Schofield et al. | 430/546 |
| 5,250,406 | 10/1993 | Yamamoto et al. | 430/557 |
| 5,294,524 | 3/1994 | Ishii et al. | 430/557 |
| 5,314,797 | 5/1994 | Yoshioka et al. | 430/557 |
| 5,316,903 | 5/1994 | Tomiyama | 430/557 |
| 5,359,080 | 10/1994 | Shimura et al. | 548/317.5 |
| 5,376,513 | 12/1994 | Mihayashi et al. | 430/557 |

FOREIGN PATENT DOCUMENTS

| | | | |
|---|---|---|---|
| 447969 | 9/1991 | European Pat. Off. | 430/557 |

*Primary Examiner*—Richard L. Schilling
*Attorney, Agent, or Firm*—Birch, Stewart, Kolasch & Birch

[57] ABSTRACT

A multilayer silver halide color light-sensitive material including a yellow color-forming silver halide emulsion layer, a magenta color-forming silver halide emulsion layer, and a cyan color-forming silver halide emulsion layer, on a support. The light-sensitive material contains, in the yellow color-forming silver halide emulsion layer, at least one acylacetamide-type yellow coupler having an acyl group of a specified structure, and at least one organic compound selected from the group consisting of specified epoxy compounds, specified amide compounds, and esters having a melting point of 25° C. or more at normal pressure and a molecular weight of 1000 or less.

15 Claims, No Drawings

SILVER HALIDE PHOTOGRAPHIC LIGHT-SENSITIVE MATERIAL

This application is a divisional of application Ser. No. 07/871,762, filed on Apr. 17, 1992, now U.S. Pat. No. 5,418,121, the entire contents of which are hereby incorporated by reference.

BACKGROUND OF THE INVENTION

1. Field of the Invention

The present invention relates to a silver halide photographic light-sensitive material containing a novel acylacetamide type yellow dye-forming coupler, and more particularly, it relates to a silver halide photographic light-sensitive material which is reduced in fogging by development in running state and which is enhanced in the storage stability of color images against light or heat.

2. Description of the Related Art

In a silver halide color photographic light-sensitive material, a color image is formed by the reaction of an oxidized aromatic primary amine developing agent produced during color development after exposure, with a dye-forming coupler (hereinafter called a coupler).

Generally, in this method, a color reproduction method based on a subtractive color process is used, and, to reproduce blue, green and red, a yellow image, a magenta image, and a cyan image are formed which are complementary in color to blue, green, and red, respectively. The yellow dye-forming couplers (hereinafter called a yellow coupler) commonly applied to form yellow images are acylacetamide couplers and malondianilide couplers. The magenta dye-forming couplers commonly used to form magenta images are 5-pyrazolone couplers and pyrazolotriazole couplers, and the like. The cyan dye-forming couplers commonly used to form cyan images are phenol couplers and naphthol couplers.

Generally, the yellow dye, the magenta dye, and the cyan dye obtained from these couplers are formed in silver halide emulsion layers which are color-sensitive to radiations complementary in color to those the dyes absorb, or in the layers which are adjacent to the silver halide layers.

As yellow couplers, especially for image formation, acylacetamide couplers represented by benzoylacetanilide couplers and pivaloylacetanilide couplers are generally used. The former couplers generally have high coupling activity with an oxidized form of an aromatic primary amine developing agent at the time of development, and the yellow dyes formed therefrom have a large molecular extinction coefficient. It therefore finds main use in color photographic light-sensitive materials requiring high sensitivity, such as color negative film. The latter couplers are excellent in spectral absorption characteristic and fastness of their yellow dyes. It therefore finds main use in color paper and color reversal film.

Although the benzoylacetanilide-type coupler has a high coupling reactivity with an oxidized form of an aromatic primary amine developing agent at the time of color development, and the yellow dye formed therefrom has a large molecular extinction coefficient, it has poor spectral absorption characteristic of the yellow images. Although the pivaloyl acetanilide-type coupler has good spectral absorption characteristic of the yellow images, it has but low coupling reactivity with an oxidized form of an aromatic primary amine developing agent at the time of color development, and the yellow azomethine dye formed therefrom has a small molecular extinction coefficient.

The high coupling reactivity of the coupler and the large molecular extinction coefficient of the formed dye allow a high sensitivity, a large gamma value and a high color forming density, resulting in excellent color forming properties. The excellent spectral absorption characteristic in the yellow images means, for example, that the longer-wavelength portion of the spectral absorption decreases sharply to zero, exhibiting less unnecessary absorption in the green region.

Therefore, it has been desired that a yellow coupler be developed which has the advantages of both types of the couplers, that is, high color-forming properties (i.e., high coupling reactivity of the coupler and the large molecular extinction coefficient of the dye), and excellent spectral absorption characteristics of the color image.

As the acyl group of the acylacetanilide-type coupler, pivaloyl group, 7,7-dimethylnorbornane-1-carbonyl group, and 1-methylcyclohexane-1-carbonyl group are disclosed in U.S. Pat. No. 3,265,506, and cyclopropane-1-carbonyl group and cyclohexane-1-carbonyl group are disclosed are disclosed in JP-A-47-26133. The couplers specified here are inferior in coupling reactivity, small in molecular extinction coefficients of the dyes, or poor in spectral absorption characteristics of the color images.

SUMMARY OF THE INVENTION

Acylacetamide-type yellow coupler of the present invention, which has an acyl group represented by the following formula (I), possesses high coupling reactivity, and the dye formed therefrom has a large molecular extinction coefficient. In addition, the absorption of the longer-wavelength portion of the formed dye is cut sharply, and thus the coupler is preferable in terms of color reproduction.

The use of such a coupler which has a high coupling reactivity and produces a dye having a large molecular extinction coefficient will save the amounts of couplers and silver halides required to obtain a practically sufficient color-forming density.

The present inventors have conducted research and have found that a coupler having the acyl group represented by formula (I) exhibits high fog level at the development. It has been found that the fog is particularly remarkable when the development is continuously carried out while a replenisher is added (so-called running state), and that the fog becomes more prominent when the development time is prolonged. Further, they have found that this coupler needs to be further improved in storage stability of the color image.

To improve the storage stability against light, methods have hitherto been known in which stabilizing agents, such as hindered phenols and piperidine compounds, are used. Also, use of sulfur-containing cyclic compounds is disclosed in European Patents EP 0310552A1 and EP 0393718A2.

However, with the improving methods described above, the image fastness of the yellow color-forming dye is still insufficient, and hence, further improvements have been demanded.

Accordingly, an object of the present invention is to provide a color photographic light-sensitive material in which the amounts of couplers and silver halide are reduced, and which excels not only in color reproducibility but also in image storage stability, by using yellow couplers having improved spectral characteristic and improved color-developing characteristic. Another object is to provide a color photographic light-sensitive material which generates a small amount of fog when color-developed.

It has been found that the above objects are achieved according to the present invention by a multi-layer silver halide color light-sensitive material which comprises a yellow color-forming silver halide emulsion layer, a magenta color-forming silver halide emulsion layer, and a cyan color-forming silver halide emulsion layer, on a support, and contains at least one acylacetamide-type yellow coupler having an acyl group represented by the following formula (I), and at least one an organic compound represented by the following formula (II) or (III), in the yellow color-forming silver halide emulsion layer.

Formula (I)

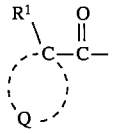

In formula (I), $R^1$ is a monovalent group, Q is a nonmetallic atomic group required to form, together with C, a 3- to 5-membered hydrocarbon ring or a 3- to 5-membered heterocyclic group having at least one hetero atom selected from the group consisting of N, S, O and P, provided that $R^1$ is not a hydrogen atom, and does not bond to Q to form a ring.

Formula (II)

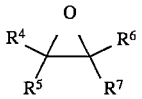

In formula (II), $R^4$, $R^5$, $R^6$, and $R^7$ each represents a hydrogen atom, an aliphatic group, an aromatic group, an aliphatic oxycarbonyl group, an aromatic oxycarbonyl group, or a carbamoyl group, provided that all of $R^4$, $R^5$, $R^6$ and $R^7$ are not simultaneously hydrogen atoms. The epoxy group represented by formula (II) may be present in the same molecule in numbers ranging from 1 to 60.

Formula (III)

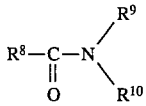

In formula (III), $R^8$, $R^9$, and $R^{10}$ each represents an alkyl group or an aryl group, which can be substituted by a substituent such as a halogen atom, an alkyl group, an alkoxy group, an aryl group, an aryloxy group, an alkylsulfonyl group, an arylsulfonyl group, an alkoxycarbonyl group, or a carbamoyl group when $R^9$ and $R^{10}$ are alkyl groups, they may bond with each other to form a 5- to 7-membered ring. This ring may contain at least one hetero atom selected from the group consisting of O, S, N and P. Further, any one of $R^9$ and $R^{10}$ may be hydrogen atom.

It has been further found that the above objects are also achieved according to the present invention by a multilayer silver halide color light-sensitive material which comprises a yellow color-forming silver halide emulsion layer, a magenta color-forming silver halide emulsion layer, and a cyan color-forming silver halide emulsion layer, on a support, and contains at least one said acylacetoamide-type yellow coupler and at least one ester having a melting point of 25° C. or more at normal pressure and a molecular weight of 1000 or less, in the yellow color-forming silver halide emulsion layer.

DETAILED DESCRIPTION OF THE PREFERRED EMBODIMENTS

The acylacetamide-type yellow coupler of the present invention is preferably represented by the following formula (Y):

Formula (Y)

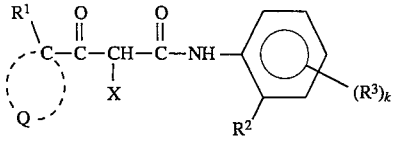

In formula (Y), $R^1$ represents a monovalent group other than a hydrogen atom, Q represents a nonmetallic atomic group required to form, together with C, a 3- to 5-membered hydrocarbon ring or a 3- to 5-membered heterocyclic ring containing at least one hetero atom selected from N, S, O, and P in the ring, $R^2$ represents hydrogen atom, a halogen atom (F, Cl, Br, or I; this will be the same in explanation of formula (Y) hereinafter), an alkoxy group, an aryloxy group, an alkyl group, or an amino group, $R^3$ represents a group which can be substituted on the benzene ring, X represents hydrogen atom or a group which can be split off upon a coupling reaction with an oxidized form of an aromatic primary amine developing agent (referred to as a split-off group hereinafter), and k represents an integer from 0 to 4. If k is plural, the plural $R^3$ groups can be the same or different.

Examples of $R^3$ are a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, an alkylsulfonyl group, an ureido group, a sulfamoylamino group, an alkoxycarbonylamino group, an alkoxysulfonyl group, an acyloxy group, nitro, a heterocyclic group, cyano, an acyl group, an amino group, an imide group, an alkylsulfonyloxy group, an arylsulfonyloxy group, carboxyl, a sulfo group and hyroxyl (these will be collectively referred to as substituent group A). Examples of the split-off group are a heterocyclic group which bonds to the coupling active position through a nitrogen atom, an aryloxy group, an arylthio group, an acyloxy group, an alkylsulfonyloxy group, an arylsulfonyloxy group, a heterocyclic oxy group, and a halogen atom.

If the substituent in formula (Y) is an alkyl group or contains an alkyl group, this alkyl group means, unless defined otherwise, a straight-chain, branched chain, or cyclic alkyl group which may be substituted and may contain an unsaturated bond.

If the substituent in formula (Y) is an aryl group or contains an aryl group, this aryl group means a monocyclic or condensed-ring aryl group which may be substituted, unless defined otherwise.

If the substituent in formula (y) is a heterocyclic group or contains a heterocyclic group, this heterocyclic group means a 3- to 8-membered monocyclic or condensed-ring heterocyclic group which contains at least one hetero atom selected from O, N, S, P, Se, and Te in its ring and may be substituted, unless defined otherwise.

The substituents preferably used in formula (Y) will be described below.

In formula (Y), $R^1$ is preferably a halogen atom, cyano, or a monovalent group having a total carbon number (hereinafter referred to as C number) of 1 to 30 carbon atoms (e.g., an alkyl group or an alkoxy group) or a monovalent group having a C number of 6 to 30 (e.g., an aryl group or an aryloxy group), each monovalent group of which may be substituted with a substituent. Examples of this substituent are a halogen atom, an alkyl group, an alkoxy group, nitro, an amino group, a carbonamide group, a sulfonamide group, and an acyl group.

In formula (Y), Q preferably represents a nonmetallic atom group required to form, together with C, a 3- to 5-membered hydrocarbon ring which has a C number of 3 to 30 and may be substituted or a 3- to 5-membered heterocyclic ring which contains at least one hetero atom selected from N, S, O, and P in the ring, has a C number of 2 to 30, and may be substituted. The ring that Q forms together with C may contain an unsaturated bond in it. Examples of the ring formed by Q together with C are cyclopropane, cyclobutane, cyclopentane, cyclopropene, cyclobutene, cyclopentene, oxetane, oxolane, 1,3-dioxolane, thiethane, thiolane, and pyrrolidine rings. Examples of its substituent are a halogen atom, hydroxyl, an alkyl group, an aryl group, an acyl group, an alkoxy group, an aryloxy group, cyano, an alkoxycarbonyl group, an alkylthio group, and an arylthio group.

In formula (Y), $R^2$ preferably represents a halogen atom, or an alkoxy group having a C number of 1 to 30, an aryloxy group having a C number of 6 to 30, an alkyl group having a C number of 1 to 30, or an amino group having a C number of 0 to 30, each of which may be substituted. Examples of its substituent are a halogen atom, an alkyl group, an alkoxy group, and an aryloxy group.

In formula (Y), $R^3$ preferably represents a halogen atom, or an alkyl group having a C number of 1 to 30, an aryl group having a C number of 6 to 30, an alkoxy group having a C number of 1 to 30, an alkoxycarbonyl group having a C number of 2 to 30, an aryloxycarbonyl group having a C number of 7 to 30, a carbonamide group having a C number of 1 to 30, a sulfonamide group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, an ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, or an arylsulfonyloxy group having a C number of 6 to 30, each of which may be substituted. Examples of its substituent include, for example, a substituent selected from the above-mentioned substituent group A.

In formula (Y), k preferably represents an integer of 1 or 2, and the position of $R^3$ is preferably meta or para to the group represented by the following formula:

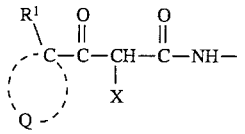

In formula (Y), X preferably represents a heterocyclic group which bonds to the coupling active position through a nitrogen atom, or an aryloxy group.

When X represents a heterocyclic group, X is preferably a 5- to 7-membered monocyclic or condensed-ring heterocyclic group which may be substituted. Examples thereof are succinimide, maleimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one, which may be substituted. Examples of its substituent are the substituents of the substitutent group A.

When X represents an aryloxy group, X is preferably an aryloxy group having a C number of 6 to 30, and may be substituted by a substituent selected from the substituents enumerated above as substituents when X represents a heterocyclic ring. A preferable substituent of the aryloxy group is a halogen atom, cyano, nitro, carboxyl, trifluoromethyl, an alkoxycarbonyl group, a carbonamide group, a sulfonamide group, a carbamoyl group, a sulfamoyl group, an alkylsulfonyl group, an arylsulfonyl group, or cyano.

The substituents particularly preferably used in formula (Y) will be described below.

$R^1$ is particularly preferably a halogen atom or an alkyl group, and more preferably an alkyl group having a C number of 1 to 5. Most preferred are ethyl and n-propyl. Q is particularly preferably a nonmetallic atomic group forming, together with C, a 3- to 5-membered hydrocarbon ring, for example, $—(CR^2)_2—$, $—(CR^2)_3—$, or $—(CR^2)_4—$, wherein R represents hydrogen atom, a halogen atom, or an alkyl group. A plurality of R's and $CR^2$'s may be the same or different.

Q is most preferably $—(CR^2)_2—$ which forms a 3-membered ring together with C bonded thereto.

$R^2$ is particularly preferably chlorine, fluorine, an alkyl group having a C number of 1 to 6 (e.g., methyl, trifluoromethyl, ethyl, isopropyl, and t-butyl), an alkoxy group having a C number of 1 to 8 (e.g., methoxy, ethoxy, methoxyethoxy, and butoxy), or an aryloxy group having a C number of 6 to 24 (e.g., phenoxy group, p-tolyloxy, and p-methoxyphenoxy), and most preferably chlorine, methoxy, or trifluoromethyl.

$R^3$ is particularly preferably a halogen atom, an alkoxy group, an alkoxycarbonyl group, an aryloxycarbonyl group, a carbonamide group, a sulfonamide group, a carbamoyl group, or a sulfamoyl group, and most preferably an alkoxy group, an alkoxycarbonyl group, a carbonamide group, or a sulfonamide group.

X is particularly preferably a 5-membered heterocyclic group which bonds to the coupling active position through a nitrogen atom ( e.g., imidazolidine-2,4-dione-3-yl or oxazolidine-2,4-dione-3-yl) or an aryloxy group, and most preferably imidazolidine-2,4-dione-3-yl.

A coupler represented by formula (Y) may form a dimer or higer polymer formed through a divalent or higher valent group of the substitutent $R^1$, Q or X, or the below-mentioned group:

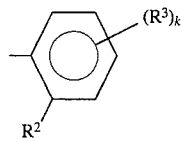

In this case, the number of carbon atoms described above in each substituent may fall outside the defined range.

Specific examples of each substituent in formula (Y) will be listed below.

① Examples of
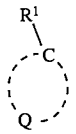
which Q forms with C, and $R^1$ are shown below.
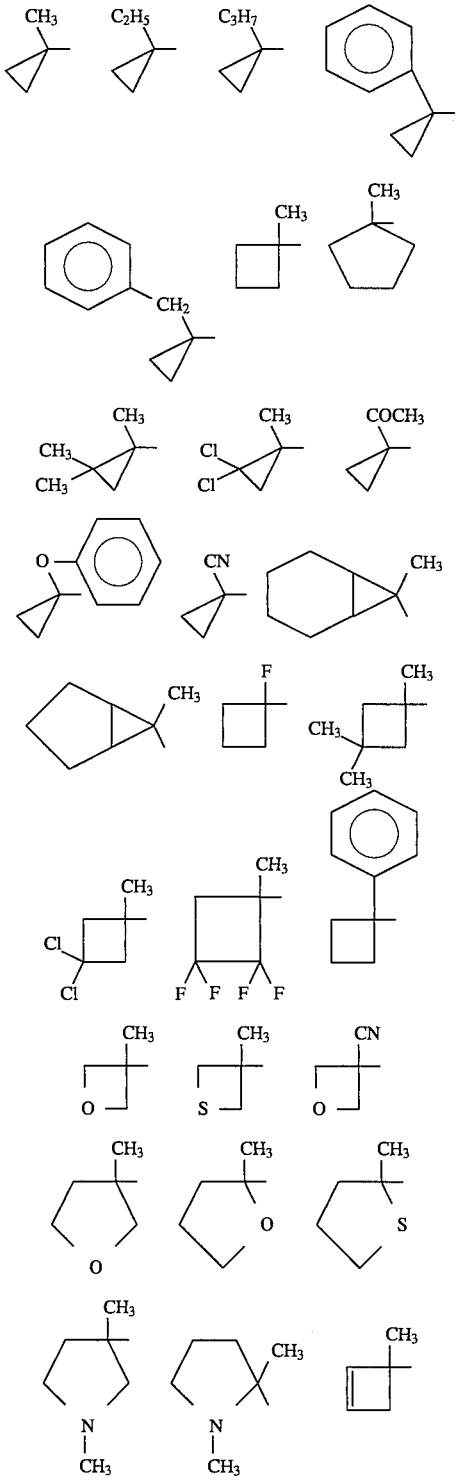
-continued
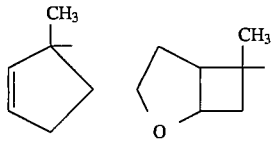
② Examples of $R^2$:
F, Cl, Br, I, $CH_3O$—, 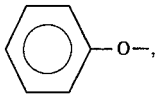 —O—,
$CH_3O$— 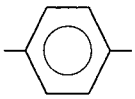 —O—, $CH_3$—, $C_2H_5$—, i-$C_3H_7$—,
t-$C_4H_9$—, $CH_3OCH_2CH_2O$—, $CF_3$—, $(CH_3)_2N$—,
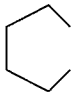 N— n-$C_4H_9O$—, n-$C_{14}H_{29}O$—, n-$C_{16}H_{33}O$—,
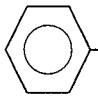 $CH_2O$—, n-$C_{12}H_{25}O$—
③ Examples of $R^3$
F Cl Br I —$OCH_3$ —$OC_{12}H_{25}$ —$OC_{16}H_{33}$
—$COOCH_3$ —$COOC_{12}H_{25}$ —$COOCH(CH_3)COOC_{12}H_{25}$
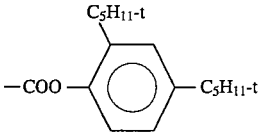
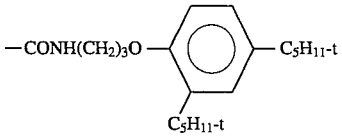
—$SO_2NH(CH_2)_3OC_{12}H_{25}$ —$SO_2N(C_8H_{17})_2$
—$SO_2N(CH_3)_2$ —$SO_2NHCOC_2H_5$ —$NHCOC_{13}H_{27}$
—$NHCOCH(C_6H_{13})C_8H_{17}$ —$NHCO(CH_2)_3O$ 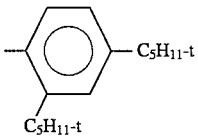
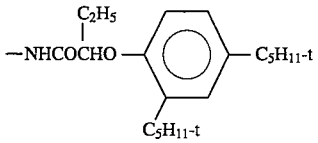

-continued
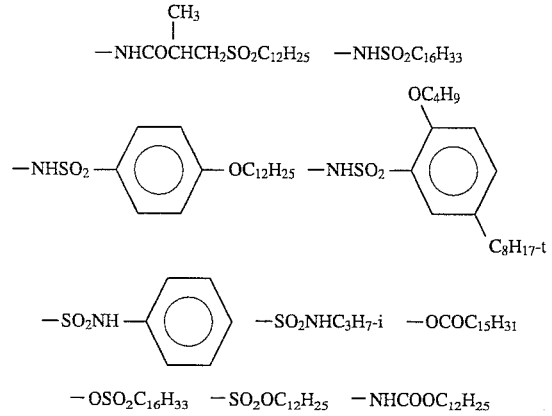
④ Examples of X
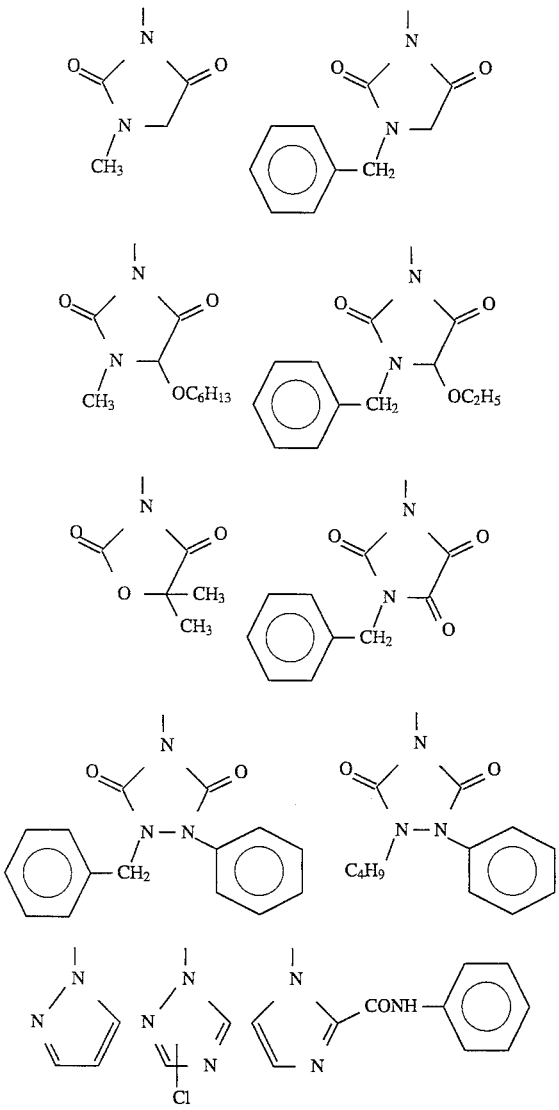
-continued
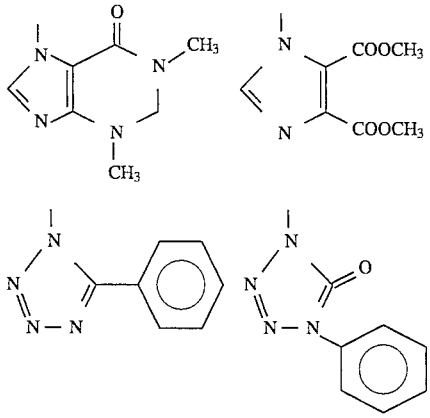
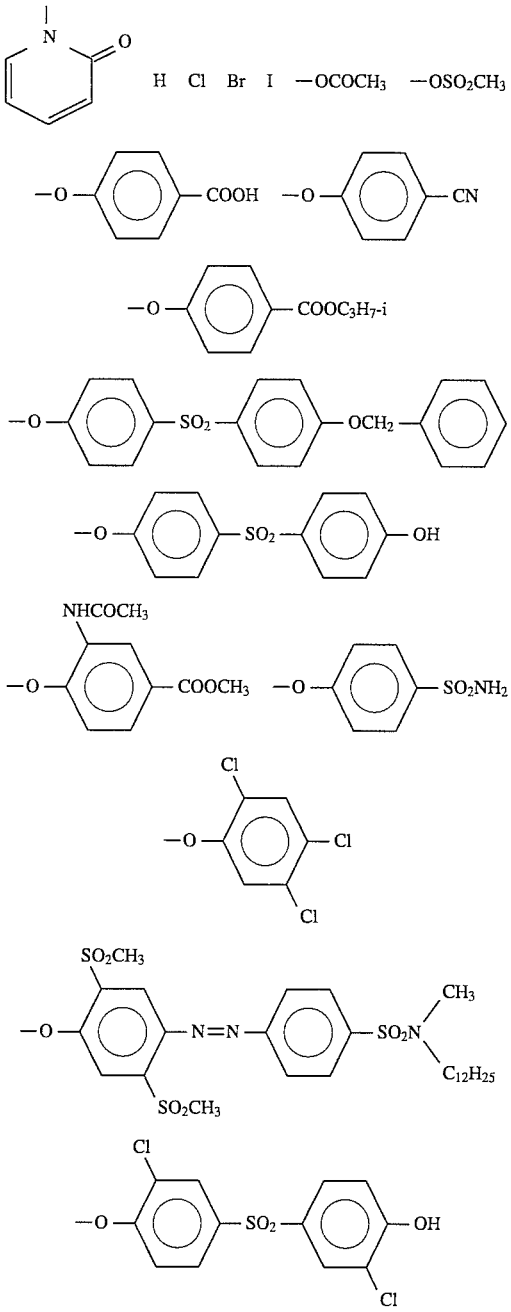

-continued
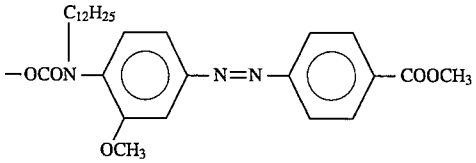
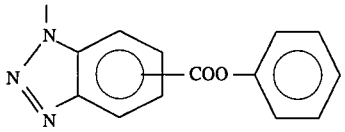
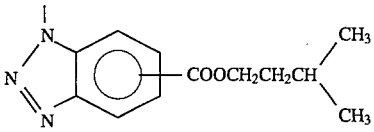
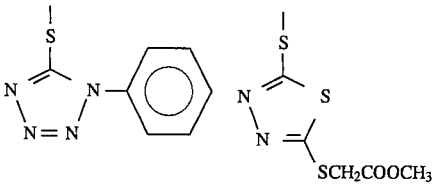
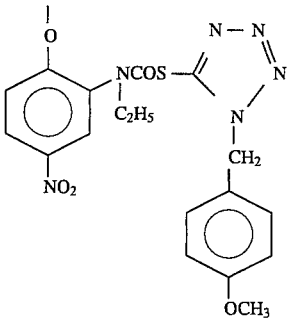
-continued
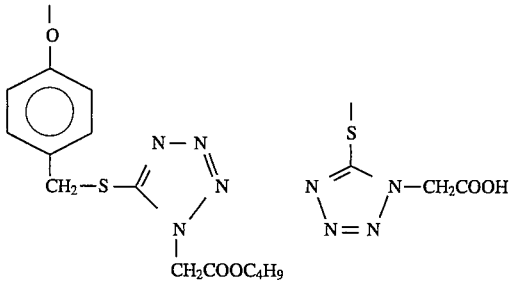
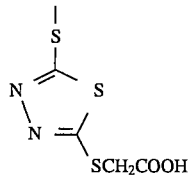
Specific examples (Y-1 to Y-38) of a yellow coupler represented by formula (Y) are presented below.
Y-1
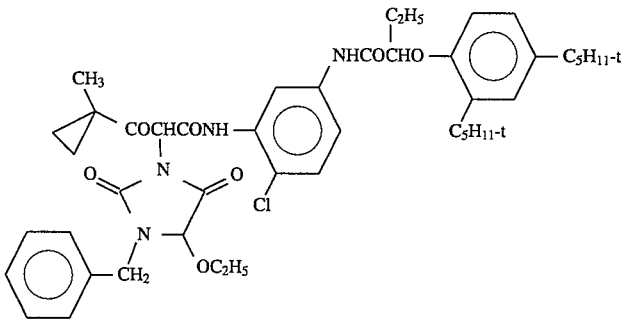
Y-2
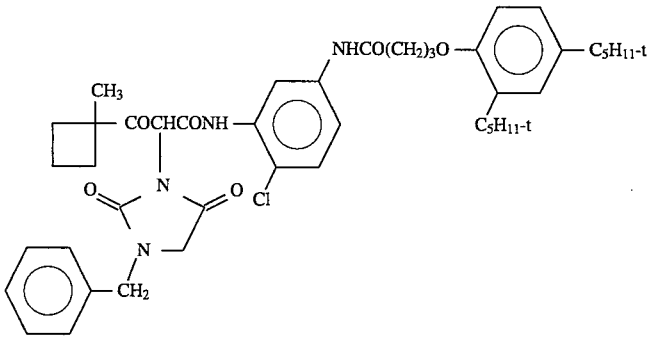

-continued
Y-3
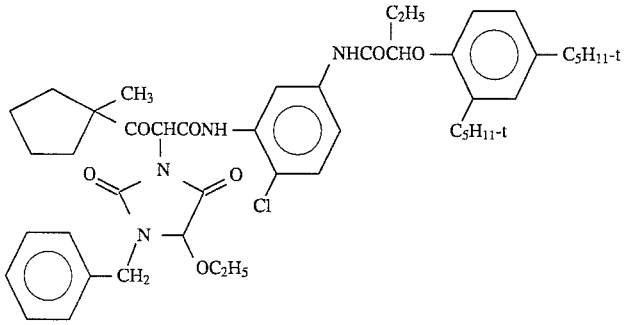
Y-4
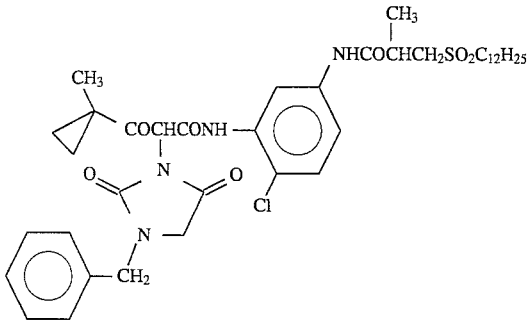
Y-5
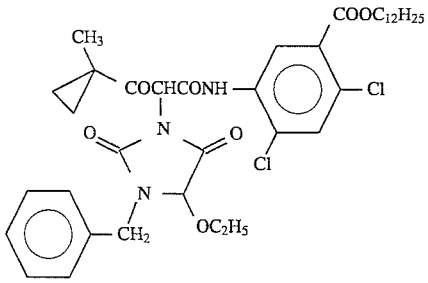
Y-6
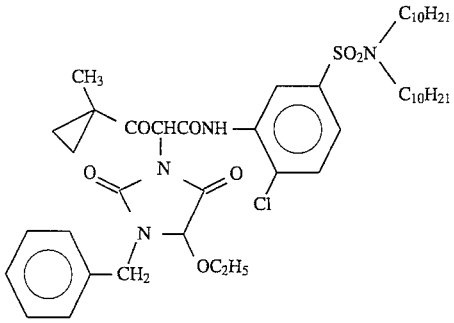
Y-7
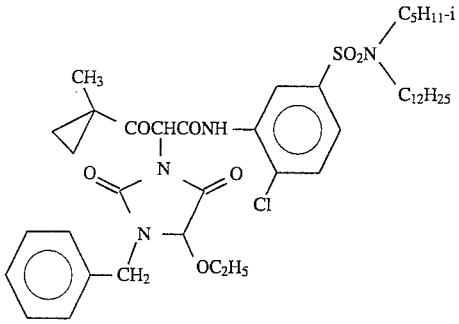

-continued
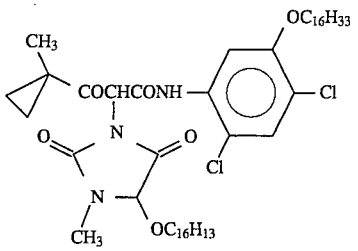
Y-8
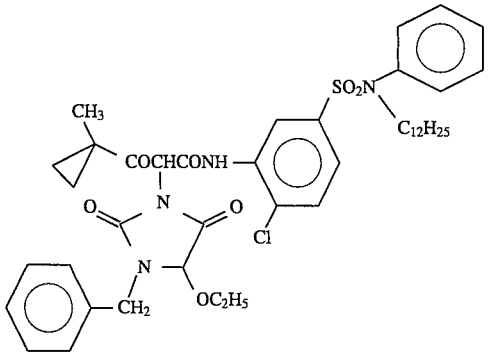
Y-9
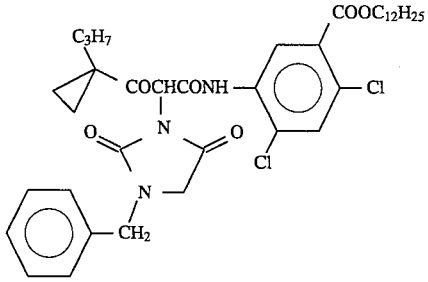
Y-10
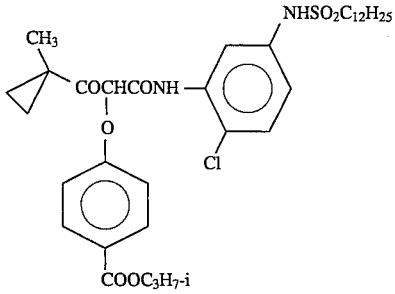
Y-11
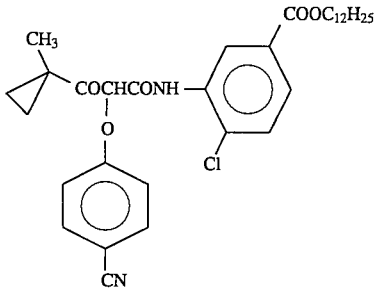
Y-12

-continued
Y-13
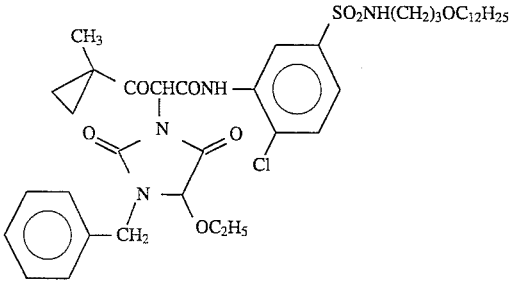
Y-14
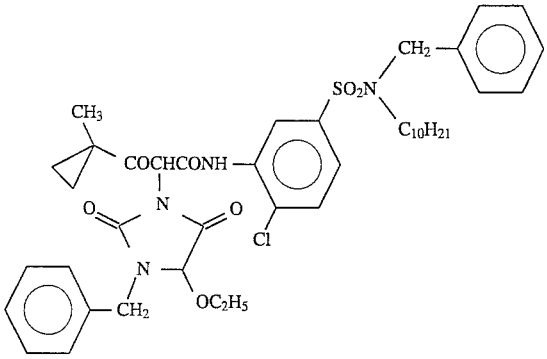
Y-15
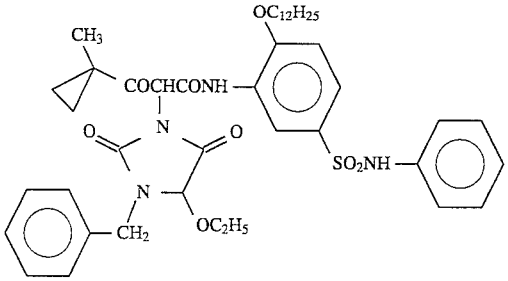
Y-16
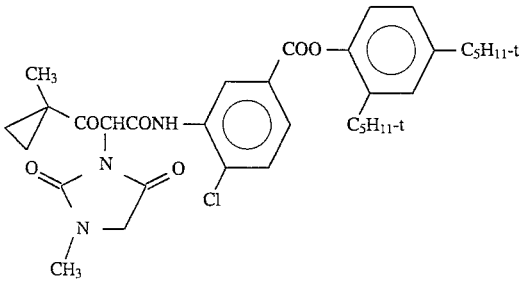
Y-17
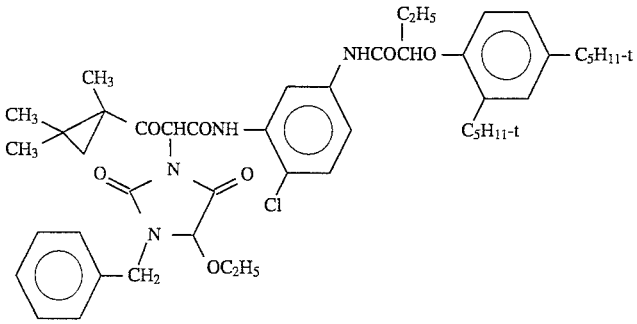

-continued
Y-18
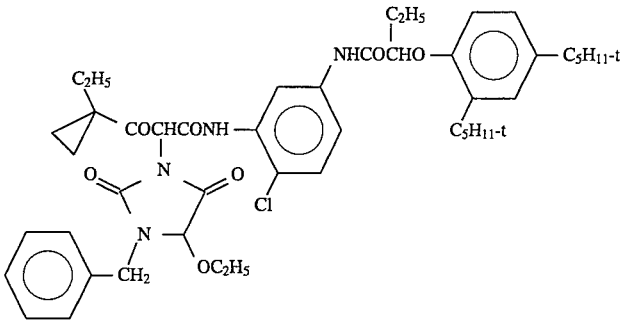
Y-19
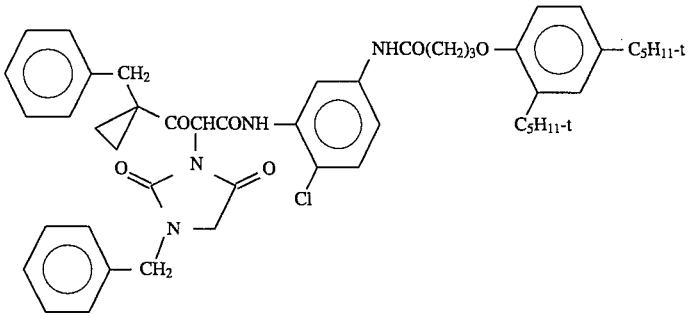
Y-20
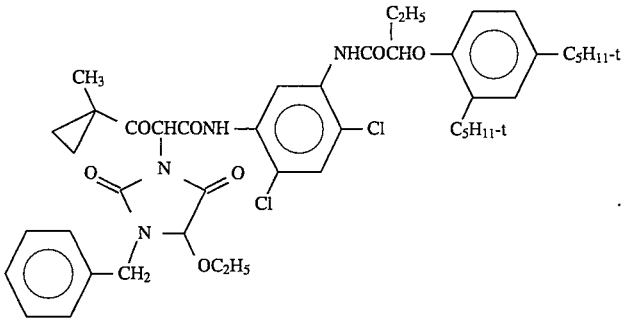
Y-21
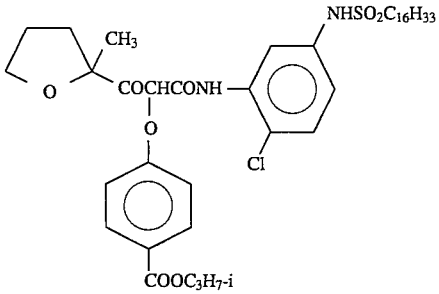
Y-22
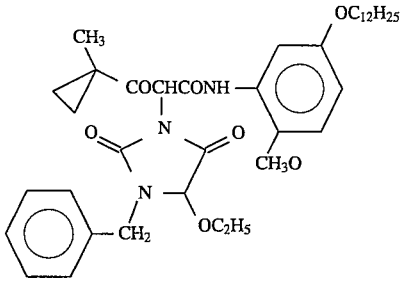

-continued
Y-23
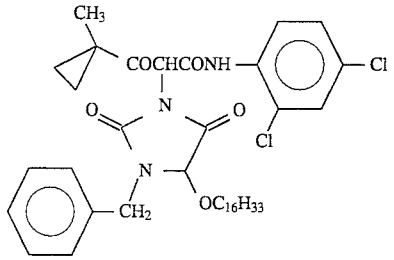
Y-24
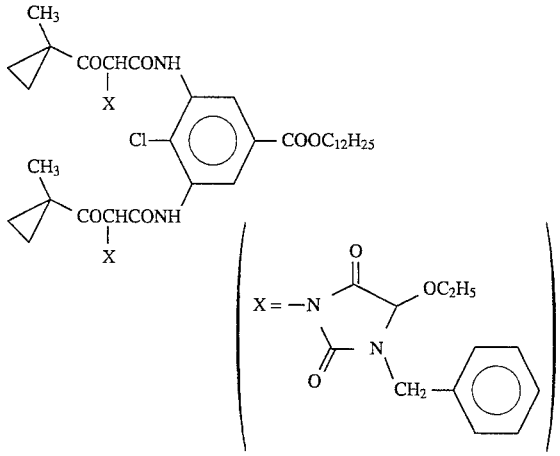
Y-25
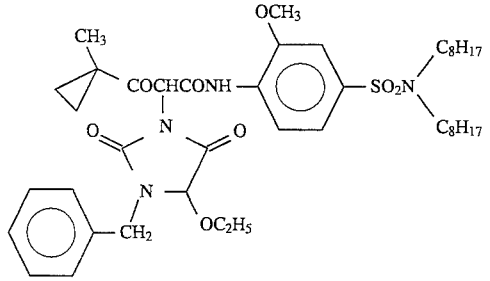
Y-26
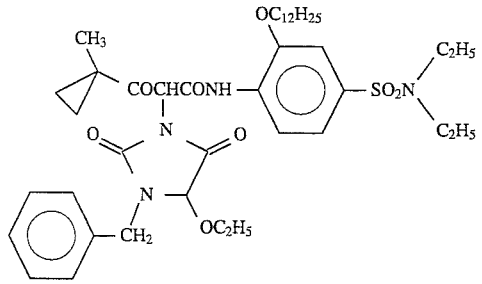
Y-27
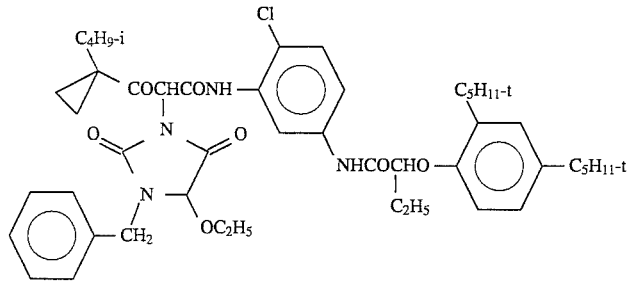

-continued
Y-28
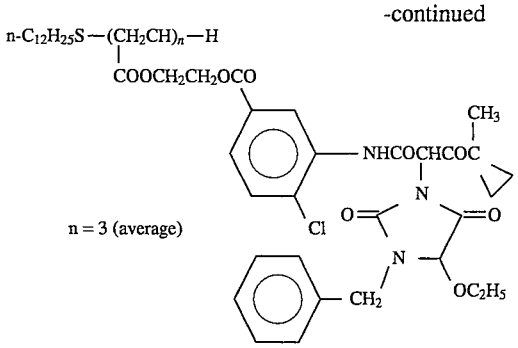
n = 3 (average)
Y-29
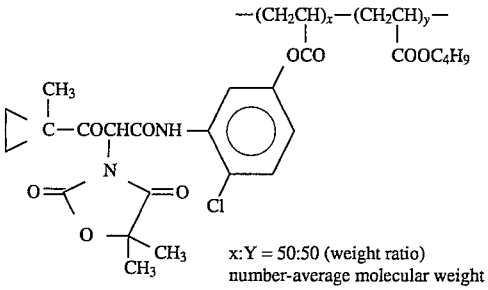
x:Y = 50:50 (weight ratio)
number-average molecular weight : 50,000
Y-30
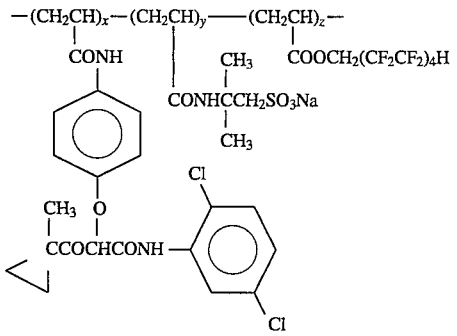
x:Y:z = 50:30:20 (weight ratio)
number-average molecular weight : 70,000
Y-31
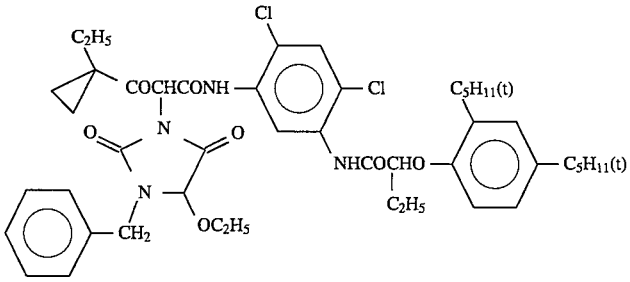
Y-32
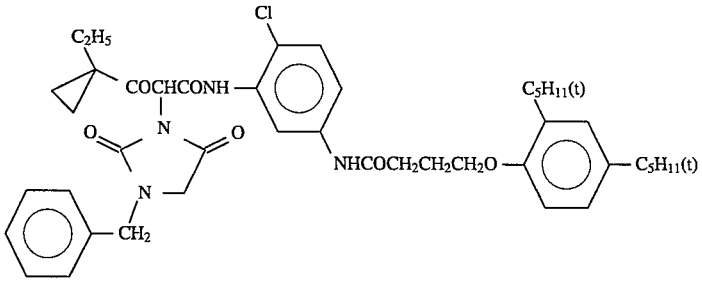

-continued
Y-33
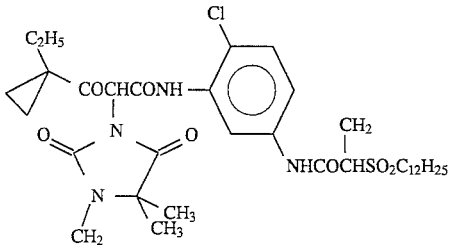
Y-34
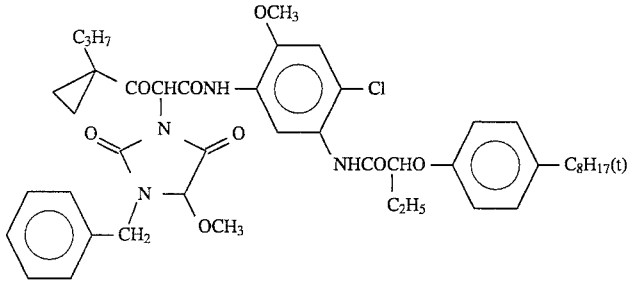
Y-35
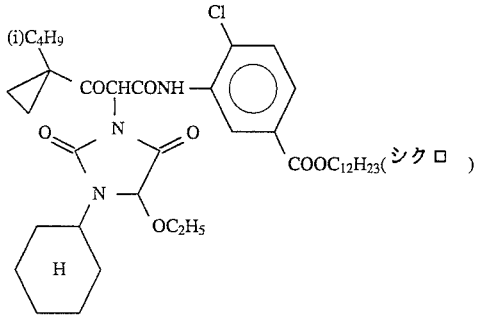
Y-36
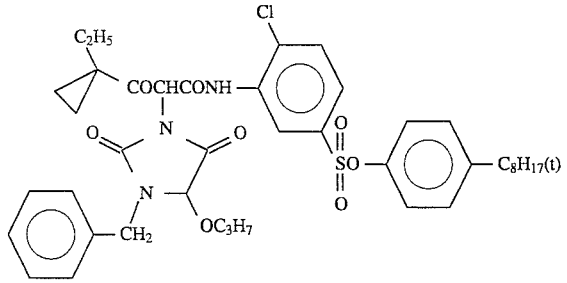
Y-37
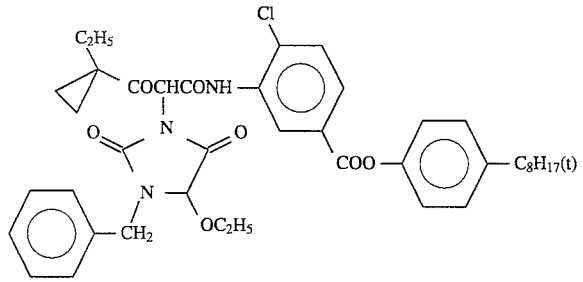

-continued

Y-38

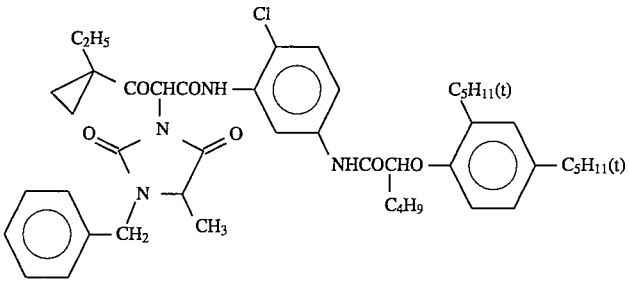

A yellow coupler represented by formula (Y) can be synthesized by a known method (e.g. a synthetic method described in JP-B-51-102636 specification) after synthesizing a carboxylic acid represented by the following formula (A).

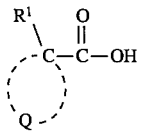

Formula (A)

The carboxylic acid of formula (A) can be synthesized by the methods described in, for example, J. Chem. Soc. (C), 1968, 2548; J. Am. Chem. Soc., 1934, 56, 2710; Synthesis, 1971, 258; J. Org. Chem., 1978, 43, 1829; and CA, 1960, 66, 18533y.

The epoxy compound represented by formula (II) of the present invention will now be described in detail. In formula (II), $R^4$, $R^5$, $R^6$, and $R^7$ are each a hydrogen atom, an aliphatic group, an aromatic group, an aliphatic oxycarbonyl group (e.g., dodecyloxycarbonyl group or allyloxycarbonyl group), an aromatic oxycarbonyl group (e.g., phenoxycarbonyl group), or a carbamoyl group (e.g., tetradecylcarbamoyl group or phenylmethylcarbamoyl group), provided all of $R^4$, $R^5$, $R^6$, and $R^7$ are not simultaneously hydrogen atoms. The epoxy group represented by formula (II) can be present in the same molecule in numbers ranging from 1 to 60.

The aliphatic group used here means a straigh-chain, branched chain or cyclic, aliphatic hydrocarbon group including a saturated or unsaturated one, such as alkyl group, alkenyl group, or alkynyl group. Typical examples thereof are methyl, ethyl, butyl, dodecyl, octadecyl, isopropyl, tert-butyl, tert-octyl, cyclohexyl, cyclopentyl, 1-methylcyclohexyl, allyl, vinyl, 2-hexadecenyl, and propagyl.

The aromatic group represents a substituent or unsubstituent phenyl group or naphtyl group, which has a C number of 6 to 42. These aliphatic group and aromatic group can be substituted by a substituent selected from, for example, an alkyl group, an aryl group, a heterocyclic group, an alkoxy group (e.g., methoxy or 2-methoxyethoxy), an aryloxy group (e.g., 2,4-di-tert-amylphenoxy, 2-chlorophenoxy, or 4-cyanophenoxy), an alkenyloxy group (e.g., 2-propenyloxy), an acyl group (e.g., acetyl or benzoyl), ester group (e.g., butoxycarbonyl, phenoxycarbonyl, acetoxy, benzoyloxy, butoxysulfonyl, or toluenesulfonyl), an amide group (e.g., acetylamino, ethylcarbamoyl, dimethylcarbamoyl, methanesulfonamide, or butylsulfamoyl), a sulfamide (e.g., dipropylsulfamoylamino), an imide group (e.g., succinimide or hydantoinyl), a ureido group (e.g., phenylureido or dimethylureido), an aliphatic or aromatic sulfonyl group (e.g., methanesulfonyl or phenylsulfonyl), aliphatic or aromatic thio group (e.g., ethylthio or phenylthio), hydroxy group, cyano, carboxy, nitro, sulfo, and a halogen atom.

Of the epoxy compounds represented by formula (II), preferable ones are those which have the group represented by the following formula (II-A):

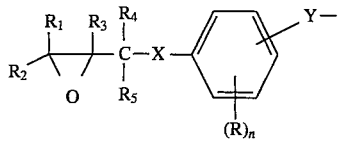

Formula (II-A)

In formula (II-A), $R_1$, $R_2$, $R_3$, $R_4$, and $R_5$ are either the same or different, and each represents a hydrogen atom, an alkyl group, or an aryl group. R is a substituent, n is an integer of 0 to 4, and —Y— is a divalent linking group. —X— is —O—, —S—, or —N(R')—. R' is a hydrogen atom, an acyl group, an alkylsulfonyl group, an arylsulfonyl group, an aryl group, a heterocyclic group, or $—C(R_6)(R_7)(R_8)$. $R_6$, $R_7$, and $R_8$ can be the same or different, and each represents an alkyl group or a group represented by the following formula (II-B). $R_6$ and $R_7$ can be hydrogen atoms.

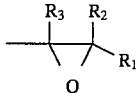

Formula (II-B)

If n is 2 to 4, the plural R groups can be the same or different.

Any two of $R_1$ to R5, R' and R, or two R groups can combine together, forming a 5- or 7-membered ring.

If —X— is —S—, the total carbon number of the compound is 15 or more. If —X— is —O—, and —Y— is $—SO_2—$ or phenylene, n is an integer of 1 to 4, or at least one of $R_1$ to $R_5$ is an alkyl group or an aryl group. If —X— is —O—, and —Y— is $—O—CO_2—$, the total number of carbon atoms of $R_1$ to $R_5$ and R is 10 or more.

In formula (II-B), $R_1$, $R_2$, and $R_3$ are the groups as defined in conjunction with formula (II-A).

The group represented by formula (II-A) can combine with a hydrogen atom, a nitrogen atom, a sulfur atom, or an oxygen atom.

Of the epoxy compounds having the groups of formula (II-A), preferable are those which have at least 3 groups of formula (II-A) each, more preferable are those which have at least 4 groups of formula (II-A) each, and still more preferable are those which have at least 5 groups of formula (II-A) each.

Of the epoxy compounds having the groups of formula (II-A), preferable are those which have at least 2 benzene rings each, more preferable are those which have at least 3 benzene rings each, and still more preferable are those which have at least 4 benzene rings each.

Of the epoxy compounds having the groups of formula (II-A), more preferable are those which are represented by the following formula (II-C):

Formula (II-C)

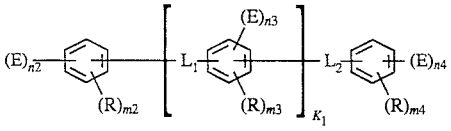

In formula (II-C), E is represented by the following formula (II-D):

Formula (II-D)

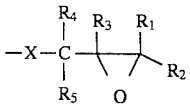

In formula (II-D), $R_1$ to $R_5$ and X are the groups defined in conjunction with formula (II-A).

In formula (II-C), R is the group defined by formula (II-A), and $L_1$ and $L_2$ can be either the same or different, and each represents a divalent linking group. Preferable as $L_1$ and $L_2$ are alkyl groups which can have substituent, including the structures represented by the following formulas:

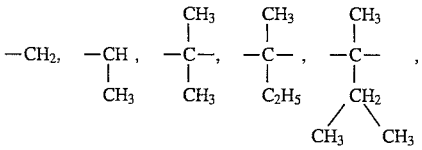

-continued

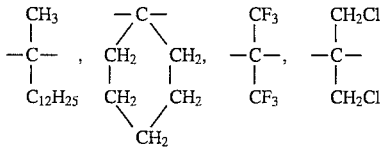

n2, n3, n4, m2, m3, and m4 are integers, ranging from 1 to 5, from 1 to 4, from 1 to 5, from 0 to 4, from 0 to 3, and from 0 to 4, respectively. k1 is an integer of 0 to 20.

If two or more Es are present in plurality, they can be the same or different, and if two or more Rs are present, they can be the same or different.

The compound of formula (II-C) can be in the form of a mixture in which the values of k are different.

Of the compounds represented by formula (II-C), preferable are those wherein: —X—is —O—, k1 is 1 to 20, preferably 2 to 20, more preferably 3 to 20, and most preferably 4 to 20; n2, n3 and n4 are 1 or 2; m2, m3 and m4 are 0 to 3 and most preferably 1 or 2; and R is an alkyl group, a halogen atom, or alkoxy group.

Examples (E-1 to E-35) of the compound represented by formula (II) of the invention are shown below, but the invention should not be limited thereto.

E-1

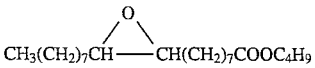

E-2

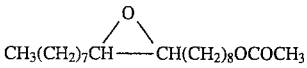

E-3

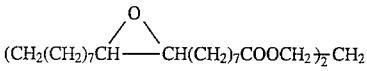

E-4

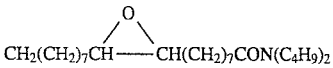

E-5

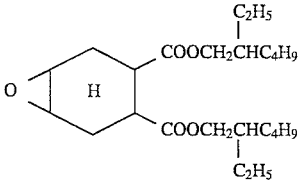

E-6

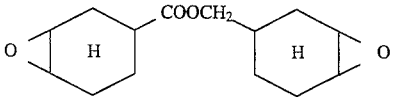

E-7

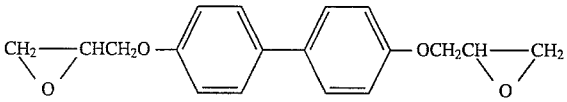

E-8

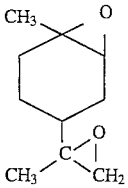

-continued
E-9
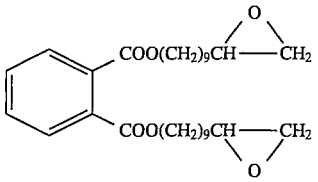
E-10
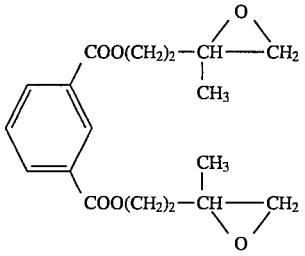
E-11
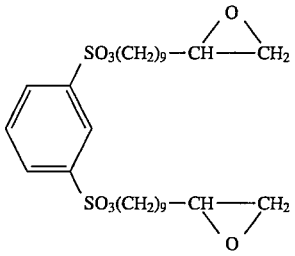
E-12
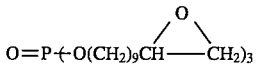
E-13
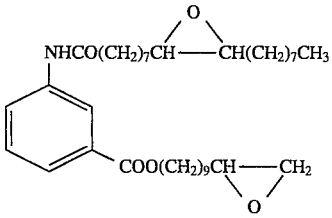
E-14
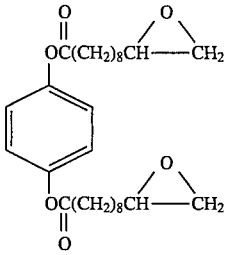
E-15
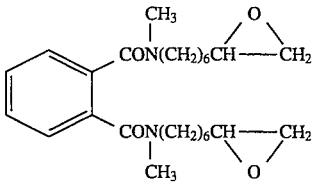

-continued
E-16
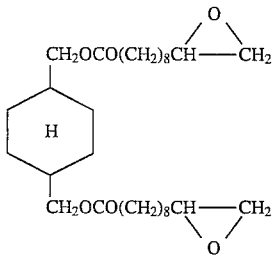
E-17
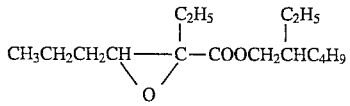
E-18
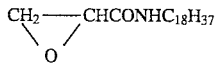
E-19
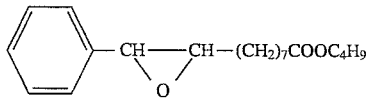
E-20
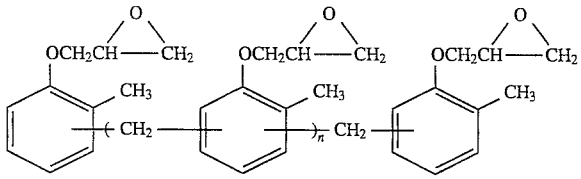
A mixture in which n = 0 to 7
E-21
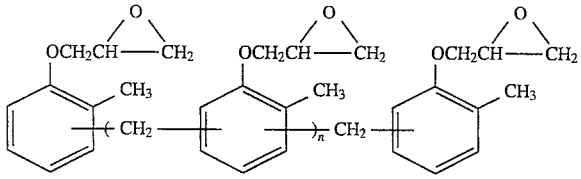
A mixture in which n = 3 to 12
E-22
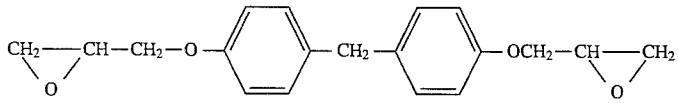
E-23
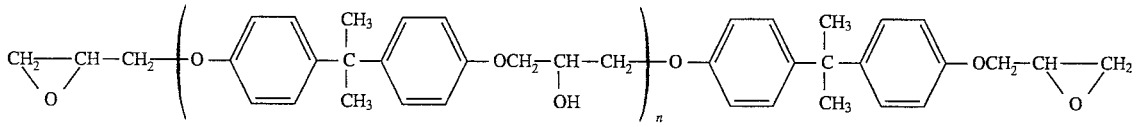
A mixture in which n = 0 to 7
E-24
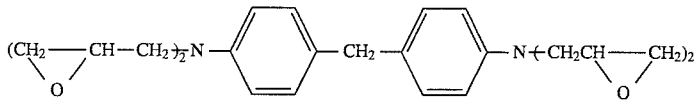
E-25
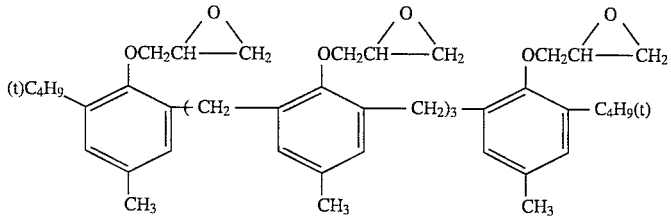

-continued
E-26
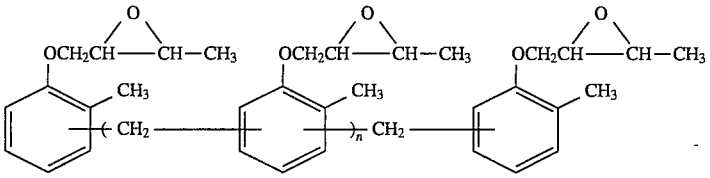
A mixture in which n = 0 to 7
E-27
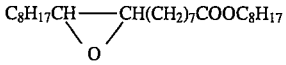
E-28
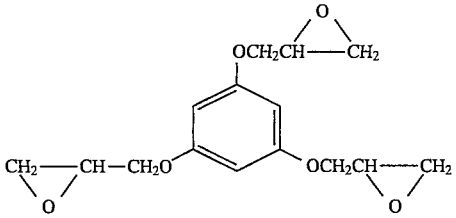
E-29
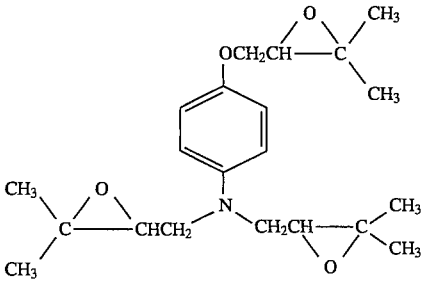
E-30
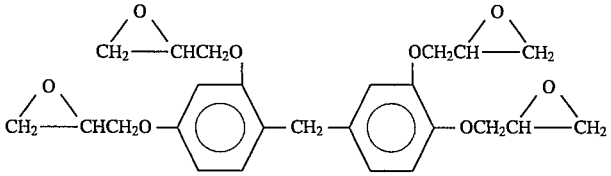
E-31
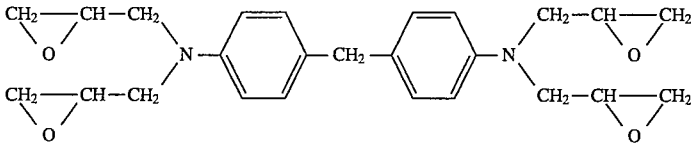
E-32
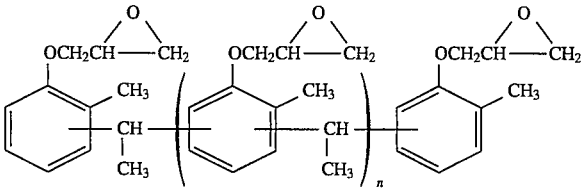
n = 1 to 2
E-33
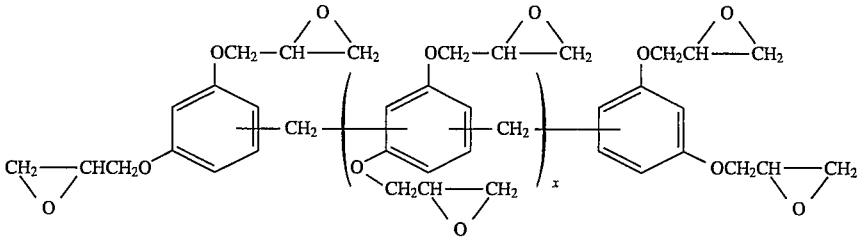

-continued

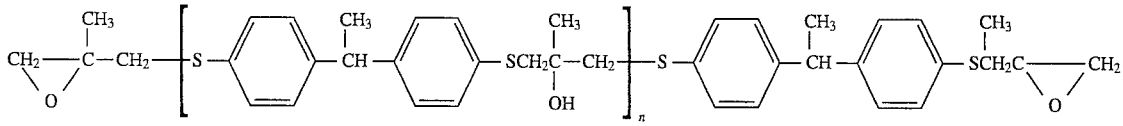

E-34 n = 3 to 6

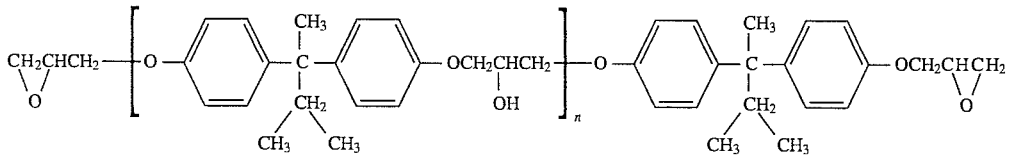

E-35

A mixture in which n = 1 to 10

The amide compound represented by formula (III) will now be described in detail.

In formula (III), $R^8$, $R^9$, and $R^{10}$ are preferably alkyl groups each having 1 to 36 carbon atoms, or aryl groups having 6 to 36 carbon atoms. These groups can be substituted by a substituent such as a halogen atom, an alkyl group, an alkoxy group, an aryl group, an aryloxy group, an alkylsulfonyl group, an arylsulfonyl group, an alkoxycarbony group, or a carbamoyl group. If $R^9$ and $R^{10}$ are both alkyl groups, they can combine together, forming a 5- to 7-membered ring. This ring can contain at least one hetero atom selected from the group consisting of O, S, N and P. Further, either $R^9$ or $R^{10}$ can be a hydrogen atom.

Of the compounds of formula (III), those represented by the following formula (IV) are particularly preferred:

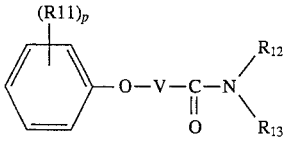

(Formula (IV)

In the formula, $R^{11}$ is a halogen atom (a fluorine atom, a chlorine atom, a bromine atom, or an iodine atom), an alkyl group having 1 to 24 carbon atoms (e.g., methyl, ethyl, iso-propyl, tert-butyl, tert-pentyl, cyclopentyl, cyclohexyl, 1,1,3,3-tetramethylpropyl, n-decyl, n-pentadecyl, or tert-pentadecyl), or an alkoxy group having 1 to 24 carbon atoms (e.g., methoxy, ethoxy, butoxy, octyloxy, benzyloxy, or dodecyloxy). $R^{12}$ and $R^{13}$ are each a hydrogen atom or an alkyl group having 1 to 24 carbon atoms (e.g., methyl, ethyl, isopropyl, tert-butyl, methoxyethyl, benzyl, 2-ethylhexyl, n-hexyl, n-decyl, or n-dodecyl). V is an alkylene group having 1 to 24 carbon atoms (e.g., methylene, ethylene, trimethylene, ethylidene, or propylidene). P is an integer ranging from 1 to 3. If p is plural, $R^{11}$s can be either the same or different. $R^{12}$ and $R^{13}$ can combine together, forming a 5- to 7-membered ring.

This ring can contain at least one hetero atom selected from the group consisting of O, S, N, and P. Further, either $R^9$ or $R^{10}$ can be a hydrogen atom.

Examples (A-1 to A-30) of the amide compounds represented by formula (III) will be shown below, but the present invention should not be limited thereto.

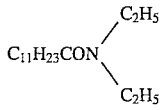

A-1

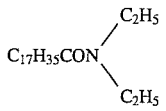

A-2

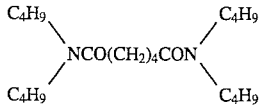

A-3

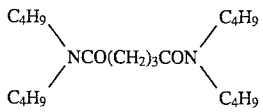

A-4

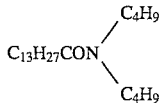

A-5

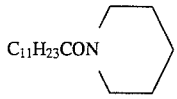

A-6

-continued
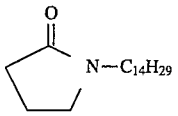
A-7
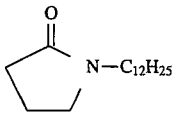
A-8
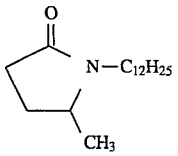
A-9
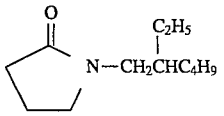
A-10
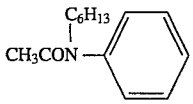
A-11
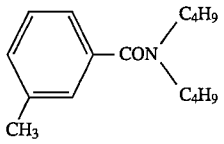
A-12
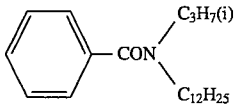
A-13
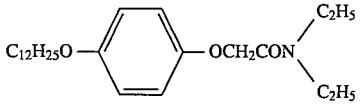
A-14
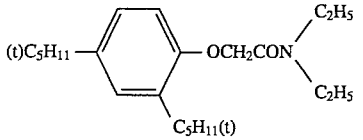
A-15
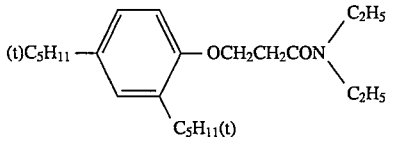
A-16
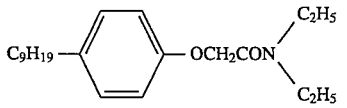
A-17
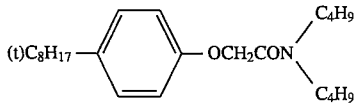
A-18

-continued
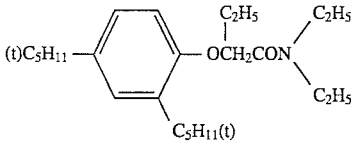
A-19
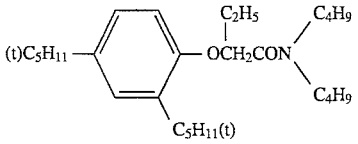
A-20
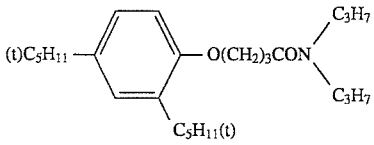
A-21
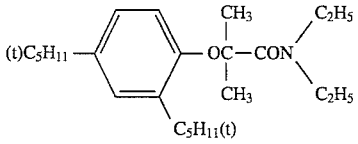
A-22
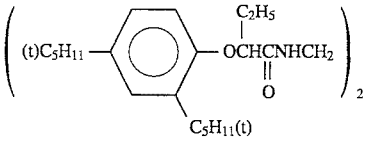
A-23
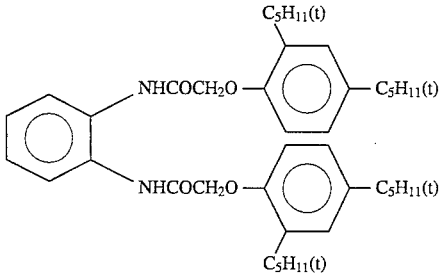
A-24
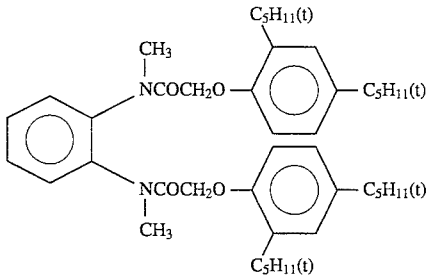
A-25
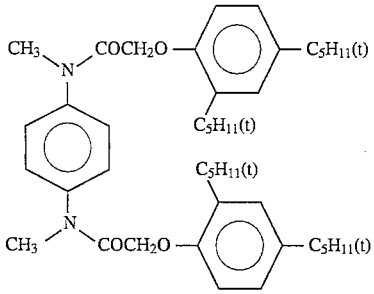
A-26

-continued

A-27

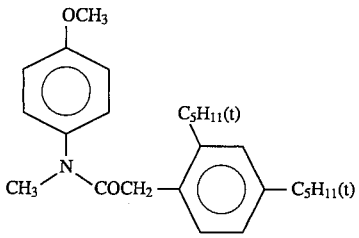

A-28

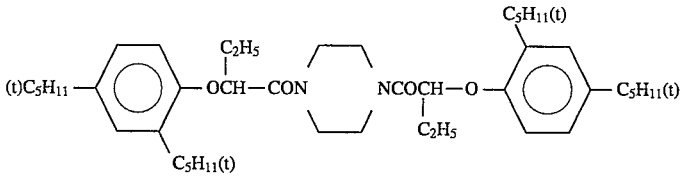

A-29

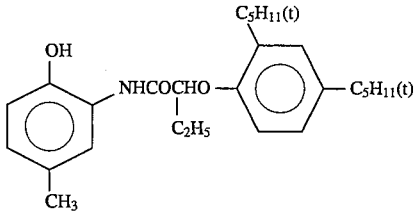

A-30

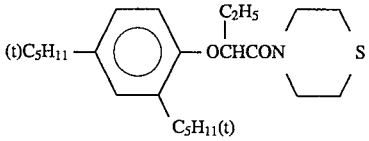

These amide compounds can be synthesized by a known method, for example, condensation reaction of a carboxylic acid anhydride or carboxylic acid chloride with an amine. Specific examples of this method are disclosed in, for example, Published Examined Japanese Patent Application 58-25260, JP-A-62-254149, U.S. Pat. No. 4,171,975.

The esters having melting points of 25° C. or more at normal pressure and molecular weights of 1000 or less used in the present invention (hereinafter referred to as esters of the present invention) are preferably selected from aliphatic carboxylic acid esters, aromatic carboxylic acid esters, and phosphoric acid esters.

The melting point at normal pressure of the esters of the present invention is preferably 25° C. to 200° C., more preferably 40° C. to 150° C., and most preferably 50° C. to 120° C.

The molecular weight of the esters of the present invention is preferably 150 to 1000, more preferably 250 to 800, and particularly preferably 300 to 700.

The esters of the present invention are preferably selected from esters which are represented by the following formulas (1), (2), (3) and (4):

$$R^1-COO-R^2 \qquad \text{Formula (1)}$$

Formula (2)

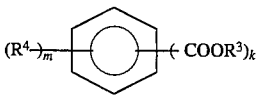

-continued

Formula (3)

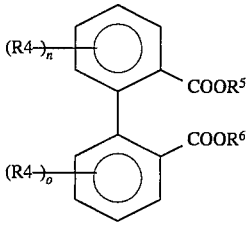

Formula (4)

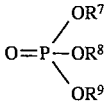

In formulas (1) to (4), $R^1$ is a straight chain or branched chain alkyl group having a total carbon number (hereinafter called C number) of 1 to 36, or a cycloalkyl group having a C number of 3 to 36. $R^2$, $R^3$, $R^5$, $R^6$, $R^7$, $R^8$, and $R^9$ are each a straight chain or branched chain alkyl group group having a C number of 1 to 36, a cycloalkyl group having a C number to 3 to 36, or an aryl group having a C number of 6 to 36. $R^4$ is a halogen atom, a straight chain or branched chain alkyl group having a C number of 1 to 12, or a straight chain or branched chain alkoxy group having a C number of 1 to 12. k is an integer ranging from 1 to 4, m is an integer ranging from 0 to 5, and n and o are integers each ranging from 0 to 4. The sum of k and m is 6 or less.

In formulas (1) to (4), $R^1$ to $R^9$ can have a substituent, except for the case where $R^4$ is a halogen atom. Preferable as the substituent are a halogen atom, an alkyl group, an aryl group, an alkoxy group, an aryloxy group, and an alkoxycarbonyl group.

In formula (2), k is preferably 1 or 2.

In formula (3), n and o are preferably 0 or 1.

Of the esters represented by formulas (1) to (4), preferable are esters which have at least one ring (e.g., benzene, naphthalene, cyclohexane, cyclopentane, cyclobutane, norbornane, adamantane, or teterahydrofuran), and more preferable are esters which have at least two such rings. Examples (S-(1) to S-(38)) of the esters of the invention and their melting points are shown below. The melting point is the value intermediate between the temperatures at which the ester started melting and melted completely, determined with eyes, respectively, as it was heated at the rate of 1° C./min, using a capillary-type melting point meter (BUCHI Model 510),

| | | Melting point (°C.) |
|---|---|---|
| S-(1) | $C_{17}H_{35}COOCH_3$ | 38 |
| S-(2) | $C_{15}H_{31}COOC_{16}H_{33}$ | 54 |
| S-(3) | $C_{11}H_{23}COOCH_2CH(OH)CH_2OH$ | 61 |
| S-(4) | 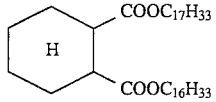 | 48 |
| S-(5) | 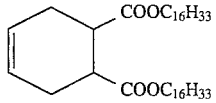 | 50 |
| S-(6) | $CH_2OCOC_{11}H_{23}$<br>\|<br>$CHOCOC_{11}H_{23}$<br>\|<br>$CH_2OC_{11}H_{23}$ | 47 |
| S-(7) | 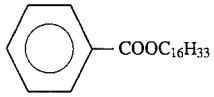 | 36 |
| S-(8) | 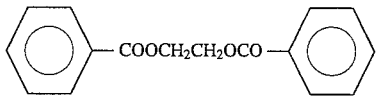 | 58 |
| S-(9) | 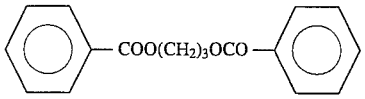 | 47 |
| S-(10) | 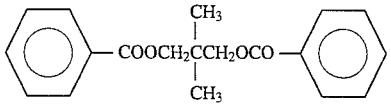 | 49 |
| S-(11) | 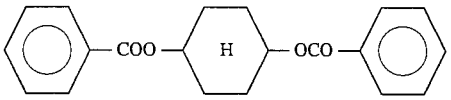 | 113 |
| S-(12) | 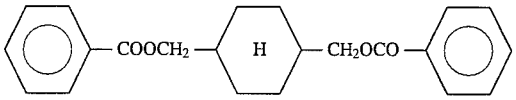 | 124 |
| S-(13) | 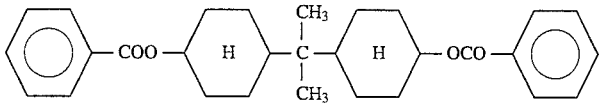 | 194 |

-continued
| | | Melting point (°C.) |
|---|---|---|
| S-(14) | 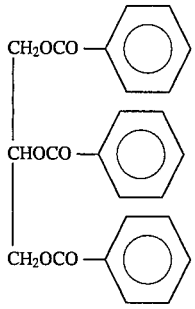 | 71 |
| S-(15) | 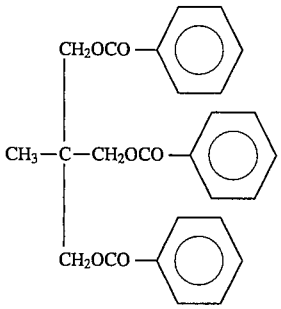 | 81 |
| S-(16) | 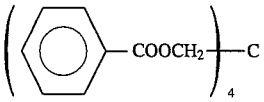 | 99 |
| S-(17) | 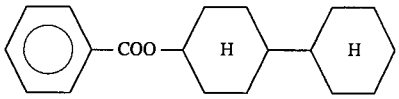 | 76 |
| S-(18) | 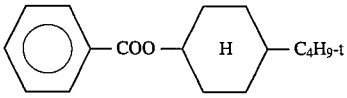 | 89 |
| S-(19) | 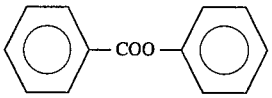 | 70 |
| S-(20) | 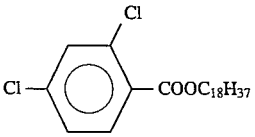 | 48 |
| S-(28) | 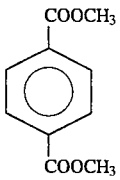 | 44 |
| S-(29) | 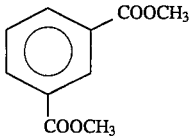 | 67 |

-continued
| | | Melting point (°C.) |
|---|---|---|
| S-(30) | 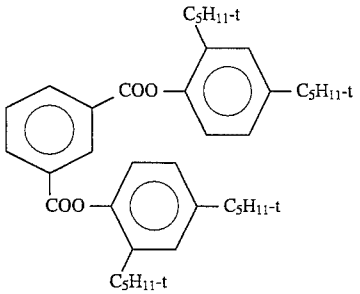 | 142 |
| S-(31) | 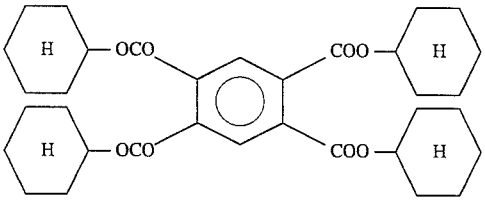 | 149 |
| S-(32) | 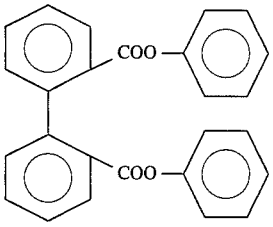 | 76 |
| S-(33) | 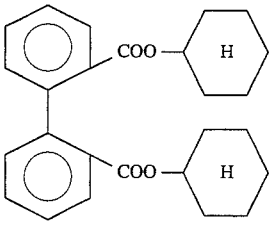 | 59 |
| S-(34) | 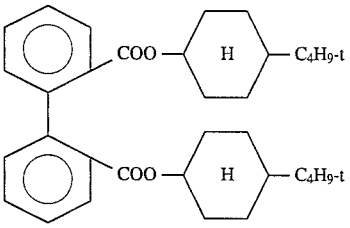 | 141 |
| S-(35) | 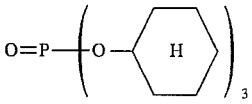 | 60 |
| S-(36) | 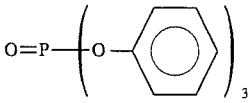 | 48 |
| S-(37) | 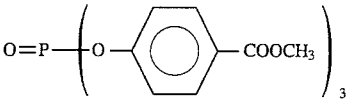 | 102 |

-continued

| | | Melting point (°C.) |
|---|---|---|
| S-(38) | 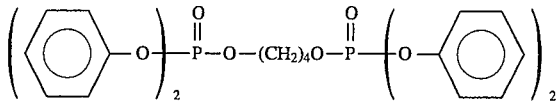 | 102 |

It is desirable that the coupler of the present invention and the compound of formula (II) or (III) for dispersion be used along with known discoloration inhibitors. Typical examples of the discoloration inhibitors are hydroquinones, 6-hydroxychromans, 5-hydroxycoumaran, spirochromans, p-alkoxy phenols, hindered phenols chiefly including bisphenols, gallic acid derivatives, methylenedioxybenzenes, aminophenols, hindered amines, and ether or ester derivatives obtained by silylating or alkylating the phenolic hydroxyl group of any of these compounds.

Specific examples of these organic discoloration inhibitors are described in the following patent specifications.

The hydroquinones are disclosed in, for example, U.S. Pat. Nos. 2,360,290, 2,418,613, 2,675,314, 2,701,197, 2,728,659, 2,732,300, 2,735,765, 3,982,944 and 4,430,425, British Patent 1,363,921, and U.S. Pat. Nos. 2,710,801 and 2,816,028. The 6-hydroxychromans, 5-hydroxychramans and spirochromans are disclosed in, for example, U.S. Pat. Nos. 3,432,300, 3,573,050, 3,574,627, 3,698,909 and 3,764,337, and JP-A-52-152225. Spiroindans are disclosed in U.S. Patent 4,360,589. The p-alkoxyphenols are disclosed in, for example, U.S. Pat. No. 2,735,765, British Patent 2,066,975, JP-A-59-10539, and JP-B-57-19765.

The hindered phenols are disclosed in, for example, U.S. Pat. No. 3,700,455, JP-A-52-72225, U.S. Pat. No. 4,228,235, and JP-B-52-6623. The gallic acid derivatives, methylenedioxybenzenes, and aminophenols are disclosed in, for example, U.S. Pat. Nos. 3,457,079 and 4,332,886, and JP-B-56-21144. The hindered amines are disclosed in for example, U.S. Pat. Nos. 3,336,135 and 4,268,593, British Patents 1,326,889, 1,354,313 and 1,410,846, JP-B-51-1420, JP-A-58-114036, JP-A-59-53846, and JP-A-59-78344.

Of the discoloration inhibitors specified above, particularly preferred are the hindered phenols which are represented by the following formula (V) and bisphenols which are represented by the following formula (VI):

Formula (V)

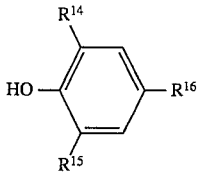

In formula (V), $R^{14}$ and $R^{15}$ are each a straight chain or branched chain alkyl group having 3 to 8 carbon atoms, particularly an alkyl group having a secondary or higher carbon atom, preferably tertiary carbon. Specific examples are n-butyl, iso-propyl, tert-butyl, and tert-amyl. The alkyl group can have an appropriate substituent at any site on the alkyl chain. $R^{16}$ is any monovalent organic group. $R^{16}$ can contains a hindered phenol moiety or a bisphenol moiety.

Formula (VI)

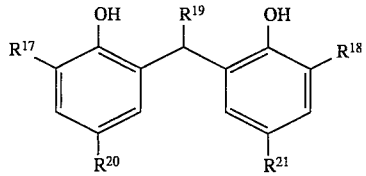

In formula (VI), $R^{17}$, $R^{18}$, $R^{20}$, and $R^{21}$ are each a straight chain or branched chain alkyl group having 1 to 8 carbon atoms. Specific examples are methyl, ethyl, n-propyl, isopropyl, tert-butyl, tert-amyl, cyclohexyl, 1-methylcyclohexyl, and cyclopentyl. The alkyl group can have an appropriate substituent including a halogen atom.

$R^{19}$ is a hydrogen atom or a straight chain or branched chain alkyl group having 1 to 8 carbon atoms. Specific examples are are methyl, ethyl, n-propyl, isopropyl, n-butyl, sec-butyl, iso-butyl, tert-amyl, and cyclohexyl.

Specific examples (HP-1 to HP-12 and BP-1 to BP-13) of the hindered phenols and bisphenols preferably used in the present invention are shown below, but should not be limited thereto.

HP-1

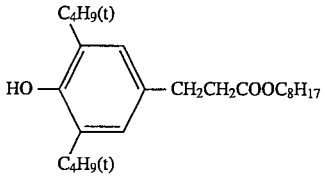

HP-2

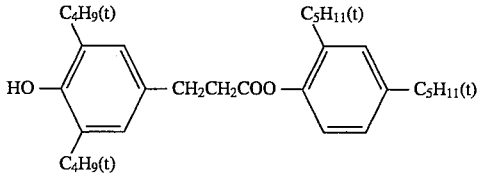

HP-3

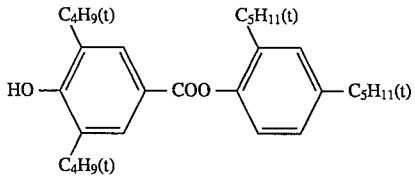

HP-4

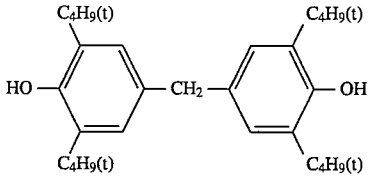

-continued
HP-5
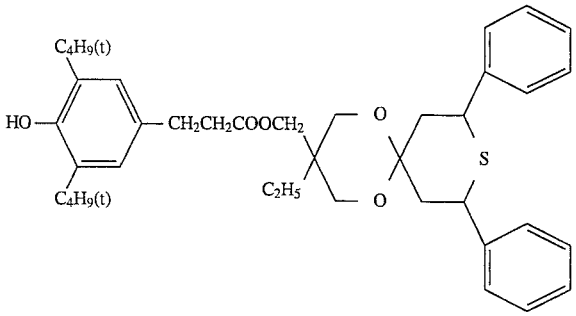
HP-6
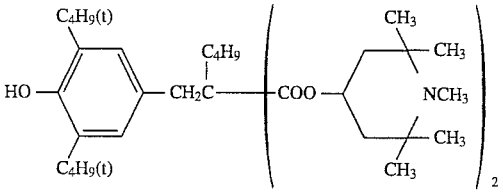
HP-7
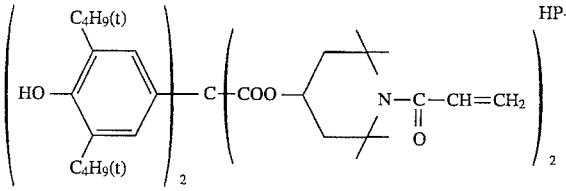
HP-8
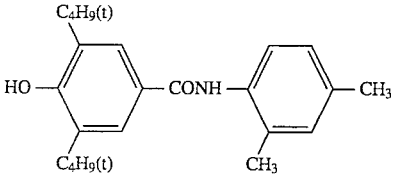
HP-9
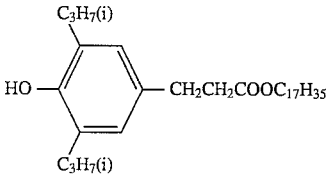
HP-10
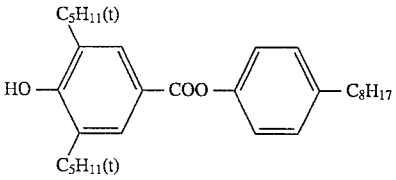
HP-11
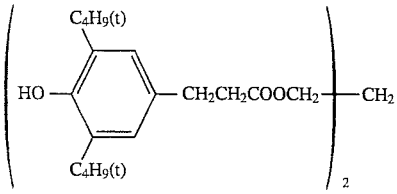
-continued
HP-12
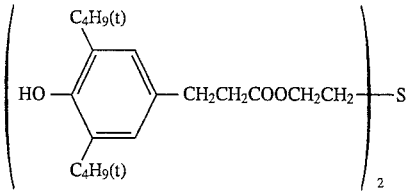
BP-1
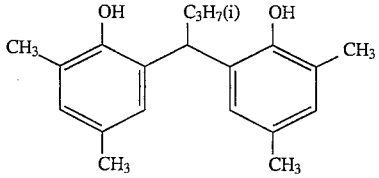
BP-2
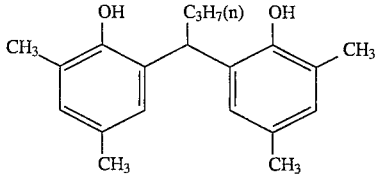
BP-3
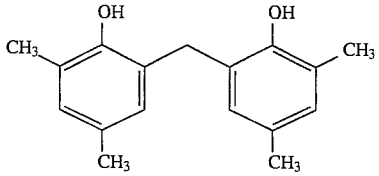
BP-4
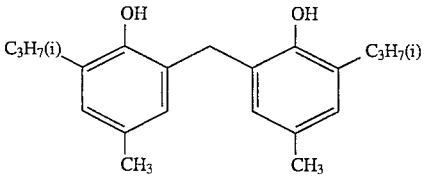
BP-5
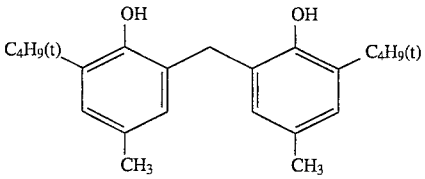
BP-6
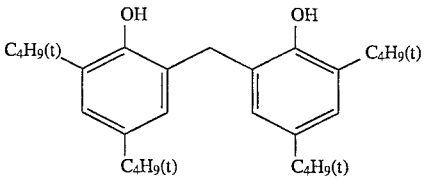
BP-7
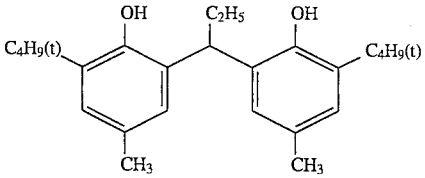
BP-8
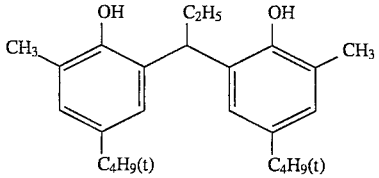

-continued

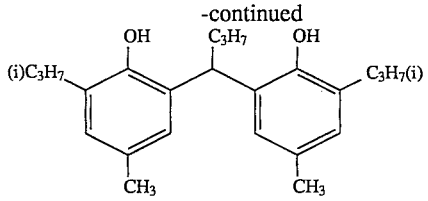

BP-9

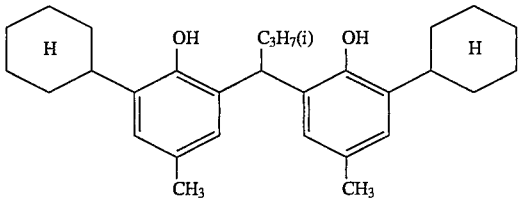

BP-10

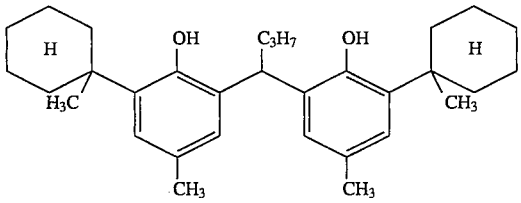

BP-11

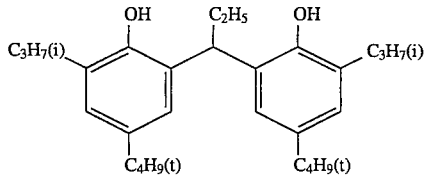

BP-12

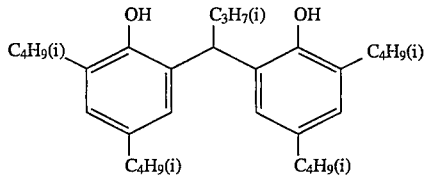

BP-13

The acetamide-type yellow coupler of the invention having the acyl group of formula (I) is used, preferably in an amount of 0.1 to 2.0 mmol/$m^2$, more preferably in an amount of 0.3 to 1.0 mmol/$m^2$.

The organic compounds of formulas (II) and (III), and the esters having a melting point of 25° C. or more and a molecular weight of 1000 or less are used, preferably in a weight ratio of 0.1 to 2.0, more preferably in a weight ratio of 0.2 to 1.0, to the total amount of yellow couplers used, including the yellow coupler of the present invention used in blue-sensitive layers. However, the epoxy compound of formula (II-C) is used, preferably in a weight ratio of 0.02 to 1.0, and more preferably in a weight ratio of 0.05 to 0.5, to the total amount of yellow couplers used.

Two or more of the compounds specified above can be used together. Further, one or more of the compounds can be used along with high-boiling point organic solvents (e.g., phosphoric acid esters or phthalic acid esters) other than the compounds of the present invention. In this case, it is desirable that a weight ratio of the total amount of all yellow couplers used to the all organic compounds other than yellow couplers be 0.1 to 2.0.

As silver halides for use in the present invention, use may be made of, for example, silver chloride, silver bromide, silver (iodo) chlorobromide, and silver iodobromide. Preferably used is silver chlorobromide or silver chloride, which contains substantially no silver iodide and has silver chloride content of 90 mol % or more, preferably 95 mol % or more, and more preferably 98 mol % or more, for the purpose of rapid processing.

In the light-sensitive material of the present invention, it is desirable that the hydrophilic colloid layers contain dyes described in EP 0,337,490A2, pp. 27–76 (particularly, oxonol-based dyes) which can be de-colored when processed, such that the light-sensitive material has optical reflection density of 0.70 or more at 680 nm. It is also desirable that the water-proof resin layer of the support contain 12 wt % or more (more preferably, 14 wt % or more) of titanium oxide surface-treated with, for example, a di- to tetra-hydric alcohol (e.g., trimethylolethane).

A high boiling point organic solvent for photographic additives such as cyan, and magenta used in the present invention can be a compound which is not miscible with water and has a melting point of 100° C. or less and a boiling point of 140° C. or more and which is a good solvent of the couplers. The melting point of the high boiling point organic solvent is preferably 80° C. or less. The boiling point of the high boiling point organic solvent is preferably 160° C. or more, and more preferably 170° C. or more.

The high boiling point organic solvents are described in detail in the lower right column of page 137 to the upper right column of page 144 in the specification of JP-A-62-215272.

The cyan, magenta, or yellow coupler can be impregnated in a loadable latex polymer (e.g., U.S. Pat. No. 4,203,716) in the presence or absence of the high boiling point organic solvent or dissolved together with a water-insoluble, organic solvent-soluble polymer, and then can be emulsified and dispersed in a hydrophilic colloidal aqueous solution.

A homopolymer or copolymer described in U.S. Pat. No. 4,856,449 and on pages 12 to 30 of the specification of WO 88/00723 is used. More preferably, a methacrylate- or acrylamide-based polymer is used. In particular, an acrylamide-based polymer is preferable in favor of, for example, dye image stabilization.

In addition, in the light-sensitive material of the present invention, it is preferable to use a dye image storage stability-improving compound as described in EP 0,277,589A2 together with the coupler, particularly a pyrazoloazole coupler.

That is, it is preferable to use one or both of a compound (F) which chemically combines with an aromatic amine-based developing agent remaining after color development to produce a chemically inactive and substantially colorless compound, and/or a compound (G) which chemically combines with an oxidized form of an aromatic amine-based color developing agent remaining after development to produce a chemically inactive and substantially colorless compound, in, e.g., preventing formation of stains or other side effects caused by a colored dye produced when a color developing agent or an oxidized from thereof remaining in a film reacts with a coupler during storage after the processing.

In the light-sensitive material of the present invention, a fungicide as described in JP-A-63-271247 is preferably added in order to prevent various mildews or bacteria which multiply in a hydrophilic colloid layer to deteriorate an image.

As a support for use in the light-sensitive material of the present invention, use may be made, for display, of a white polyester-based support, or a support in which a layer containing a white pigment is formed on the side of silver halide emulsion layers. In order to further improve a sharpness, an antihalation layer is preferably formed on the silver halide emulsion coating side or the reverse surface of the support. The transmission density of the support is preferably set within the range of 0.35 to 0.8 so that a display can be watched by reflected light or transmitted light.

The light-sensitive material of the present invention may be exposed to visible light or infrared light. The exposure method may be either low-illuminance exposure or high-illuminance short-time exposure. In the latter method, in particular, it is preferable to adopt a laser scanning exposure scheme in which the exposure time per pixel is shorter than $10^{-4}$ sec.

In exposure, a band stop filter described in U.S. Pat. No. 4,880,726 is preferably used. Since color mixing is removed by this filter, color reproducibility is significantly improved.

The exposed light-sensitive material may be subjected to conventional monochrome development or color development, but is preferably subjected to bleach-fixing after color development for the purpose of rapid processing. Especially when the high silver chloride emulsion described above is used, the pH of a bleach-fixing solution is preferably about 6.5 or less, and more preferably about 6 or less, in order to, e.g., accelerate desilvering.

As the silver halide emulsions or other materials (e.g., additives) and photographic constituting layers (e.g., a layer arrangement) applied to the light-sensitive material of the present invention, and methods and additives applied to process the light-sensitive material, those described in published patent specifications specified in the following Tables 1 to 5, particularly EP 0,355,660A2 (JP-A-2-139544), are preferably used.

TABLE 1

| Photographic constituting element and others | JP-A-62-215272 | JP-A-2-33144 | EP 0,355,660A2 |
|---|---|---|---|
| Silver halide emulsion | Line 6, upper right column, page 10 to line 5, lower left column, page 12, and the fourth line from the bottom, lower right column, page 12 to line 17, upper left column, page 13 | Line 16, upper right column, page 28 to line 11, lower right column, page 29, and lines 2 to 5, page 30 | Line 53, page 45 to line 3, page 47, and lines 20 to 22, page 47 |
| Silver halide solvent | Lines 6 to 14, lower left column, page 12, and the third line from the bottom, upper left column, page 13 to last line, lower left column, page 18 | — | — |
| Chemical sensitizer | The third line from the bottom, lower left column to the fifth line from the bottom, lower right column, page 12, and line 1, lower right column, page 18 to the ninth line from the bottom, upper right column, page 22 | Line 12 to last line, lower right column, page 29 | Lines 4 to 9, page 47 |
| Spectral sensitizer (spectral sensitizing method) | The eighth line from the bottom, upper right column, page 22 to last line, page 38 | Lines 1 to 13, upper left column, page 30 | Lines 10 to 15, page 47 |
| Emulsion stabilizer | Line 1, upper left column, page 39 to last line, upper right column, page 72 | Line 14, upper left column to line 1, upper right column, page 30 | Lines 16 to 19, page 47 |
| Development accelerator | Line 1, lower left column, page 72 to line 3, upper right column, page 91 | — | — |

TABLE 2

| Photographic constituting element and others | JP-A-62-215272 | JP-A-2-33144 | EP 0,355,660A2 |
|---|---|---|---|
| Color couplers (cyan, magenta, and yellow couplers | Line 4, upper right column, page 91 to line 6, upper left column, page 121 line 6, upper | Line 14, upper right column, page 3 to last line, upper left column, page 18, and 31, page 45, right column, page 30 to line 11, lower right column, page 35 | Lines 15 to 27, page 4, line 30, page 5 to last line, page 28, lines 29 to and line 23, page 47 to line 50, page 63 |
| Color formation reinforcing agent | Line 7, upper left column, page 121 to line 1, upper right column, page 125 | — | — |
| Ultraviolet absorbent | Line 2, upper right column, page 125 to last line, lower left column, page 127 | Line 14, lower right column, page 37 to line 11, upper left column, page 38 | Lines 22 to 31, page 65 |
| Discoloration inhibitor (image stabilizer) | Line 1, lower right column, page 127 to line 8, lower left column, page 137 | Line 12, upper right column, page 36 to line 19, upper left column, page 37 | Line 30, page 4 to line 23, page 5, line 1, page 29 to line 25, page 45, lines 33 to 40, page 45, and lines 2 to 21, page 65 |
| High and/or low | Line 9, lower left column, | Line 14, lower right column, | Lines 1 to 51, page 64 |

TABLE 2-continued

| Photo-graphic constituting element and others | JP-A-62-215272 | JP-A-2-33144 | EP 0,355,660A2 |
|---|---|---|---|
| boiling point organic solvents | page 137 to last line, upper right column, page 144 | page 35 to the fourth line from the bottom, upper left column, page 36 | |
| Method of dispersing photo-graphic additives | Line 1, lower left column, page 144 to line 7, upper right column, page 146 | Line 10, lower right column, page 27 to last line, upper left column, page 28, and line 12, lower right column, page 35 to line 7, upper right column, page 36 | Line 51, page 63 to line 56, page 64 |

TABLE 3

| Photo-graphic constituting element and others | JP-A-62-215272 | JP-A-2-33144 | EP 0,355,660A2 |
|---|---|---|---|
| Film hardener | Line 8, upper right column, page 146 to line 4, lower left column, page 155 | — | — |
| Developing agent precursor | Line 5, lower left column, page 155 to line 2, lower right column, page 155 | — | — |
| Develop-ment inhibitor releasing compound | Lines 3 to 9, lower right column, page 155 | — | — |
| Support | Line 19, lower right column, page 155 to line 14, upper left column, page 156 | Line 18, upper right column, page 38 to line 3, upper left column, page 39 | Line 29, page 66 to line 13, page 67 |
| Arrange-ment of light sensitive material layers | Line 15, upper left column, page 156 to line 14, lower right column, page 156 | Lines 1 to 15, upper right column, page 28 | Lines 41 to 52, page 45 |
| Dye | Line 15, lower right column, page 156 to last line, lower right column, page 184 | Line 12, upper left column to line 7, upper right column, page 38 | Lines 18 to 22, page 66 |
| Color mixing inhibitor | Line 1, upper left column, page 185 to line 3, lower right column, page 188 | Lines 8 to upper right column, page 36 | Line 57, page 64 to line 1, page 65 |
| Gradation adjusting agent | Lines 4 to 8, lower right column, page 188 | — | — |

TABLE 4

| Photo-graphic constituting element and others | JP-A-62-215272 | JP-A-2-33144 | EP 0,355,660A2 |
|---|---|---|---|
| Stain inhibitor (Anti-stain agent) | Line 9, lower right column, page 188 to line 10, lower right column, page 193 | Last line, upper left column to line 13, lower right column, page 37 | Line 32, page 65 to line 17, page 66 |
| Surfactant | Line 1, lower left column, page 201 to last line, upper right column, page 210 | Line 1, upper right column, page 18 to last line, lower right column, page 24, and the tenth line from the bottom, lower left column to line 9, lower right column, page 27 | — |
| Fluorine-containing compound (to be used as, e.g., antistatic agent, coating aid, lubricant, and anti-adhesion agent) | Line 1, lower left column, page 210 to line 5, lower left column, page 222 | Line 1, upper left column, page 25 to line 9, lower right column, page 27 | — |
| Binder (hydro-philic colloid) | Line 6, lower left column, page 222 to last line, upper left column, page 225 | Lines 8 to 18, upper right column, page 38 | Lines 23 to 28, page 66 |
| Thickening agent | Line 1, upper right column, page 225 to line 2, upper right column, page 227 | — | — |
| Antistatic agent | Line 3, upper right column, page 227 to line 1, upper left column, page 230 | — | — |

TABLE 5

| Photographic constituting element and others | JP-A-62-215272 | JP-A-2-33144 | EP 0, 355, 660A2 |
|---|---|---|---|
| Polymer latex | Line 2, upper left column, page 230 to last line, page 239 | — | — |
| Matting agent | Line 1, upper left column, page 240 to last line, upper right column, page 240 | — | — |
| Photographic processing method (e.g., processing steps or additives) | Line 7, upper right column, page 3 to line 5, upper right column, page 10 | Line 4, upper left column, page 39 to last line, upper left column, page 42 | Line 14, page 67 to line 28, page 69 |

A portion cited from JP-A-62-215272 includes the contents amended by the amendment, dated March 16, 1987, listed at the end of the publication.
Of the above color couplers, it is also preferable to use, as a yellow coupler, so-called short-wave type yellow couplers described in Unexamined Published Japanese Patent Application Nos. 63-231451, 63-123047, 63-241547, 1-173499, 1-213648, and 1-250944.

As a cyan coupler, in addition to a diphenylimidazole cyan coupler described in JP-A-2-33144, the use of a 3-hydroxypyridine cyan coupler (particularly a two-equivalent coupler obtained by introducing chlorine split-off groups to the 4-equivalent coupler of coupler (42), or coupler (6) or (9) enumerated as a specific example is most preferable) described in EP 0,333,185A2, or a cyclic active methylene cyan coupler (particularly couplers 3, 8, and 34 enumerated as specific examples are most preferable) described in JP-A-64-32260 is also preferable.

A method described in the upper left column of page 27 to the upper right column of page 34 of JP-A-2-207250 is preferably used as a method of processing a silver halide color light-sensitive material using a silver chloride rich emulsion containing 90 mol % or more of silver chloride.

EXAMPLE 1

After corona discharge treatment was performed on the surface of a paper support, both the surfaces of which were laminated with polyethylene, a gelatin undercoating layer containing sodium dodecylbenzenesulfonate was formed on the support, and various photographic layers were coated on it, thus preparing a multilayer color photographic paper (sample 101) having the following layer arrangement. The coating solutions were prepared as follows.

Preparation of Coating Solution of Fifth Layer 50.0 cc of ethyl acetate and 14.0 g of the solvent (Solv-6) were added to 32.0 g of the cyan coupler (ExC), 3.0 g of the dye image stabilizer (Cpd-2), 2.0 g of the dye image stabilizer (Cpd-4), 18.0 g of the dye image stabilizer (Cpd-6), 40.0 g of the dye image stabilizer (Cpd-7), and 5.0 g of the dye image stabilizer (Cpd-8) to dissolve the cyan coupler and the dye image stabilizers. The resultant solution was added to 500 cc of 20% aqueous gelatin solution containing 8 cc of sodium dodecylbenzenesulfonate, and emulsified and dispersed by using an ultrasonic homogenizer to prepare an emulsified dispersion. On the other hand, a silver bromochloride emulsion (cubic, a 1:4 mixture (Ag molar ratio) of a large-size emulsion having an average grain size of 0.58 μm and a small-size emulsion having that of 0.45 μm. The variation coefficients of grain size distributions of the two emulsions were 0.09 and 0.11, respectively. Each emulsion locally contained 0.6 mol % of AgBr in a portion of the surface of each grain) was prepared. In this emulsion, the following red-sensitive sensitizing dye E had been added to the large-size emulsion in an amount of $0.9\times10^{-4}$ mol per mol of silver and to the small-size emulsion in an amount of $1.1\times10^{-4}$ mol per mol of silver. Chemical ripening of this emulsion had been performed with the addition of a sulfur sensitizer and a gold sensitizer. This red-sensitive silver bromochloride emulsion was mixed with and dissolved in the above emulsified dispersion, thereby preparing the coating solution of the fifth layer having the composition which will be specified below.

The coating solutions for the first to fourth layers, the sixth layer, and the seventh layer were prepared in the same way as the coating solution of the fifth layer. The gelatin hardeners used in each layer were H-1 and H-2.

Dye image stabilizers Cpd-10 and Cpd-11 were added in each layer so that the total amounts were 25.0 mg/m$^2$ and 50.0 mg/m$^2$, respectively.

Use was made of the spectral sensitizing dyes in the silver bromochloride emulsions of the light-sensitive emulsion layers, as will be specified in Tables 6 to 8.

TABLE 6

Blue-sensitive emulsion layer

Sensitizing dye A

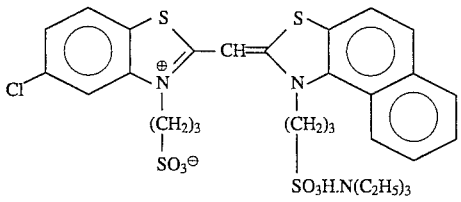

and sensitizing dye B

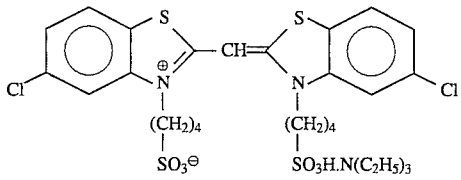

($2.0\times10^{-4}$ mol and $2.5\times10^{-4}$ mol respectively for the large- and small-size emulsions per mol of the silver halide)

TABLE 7

| Green-sensitive emulsion layer |
|---|
| Sensitizing dye C |
| 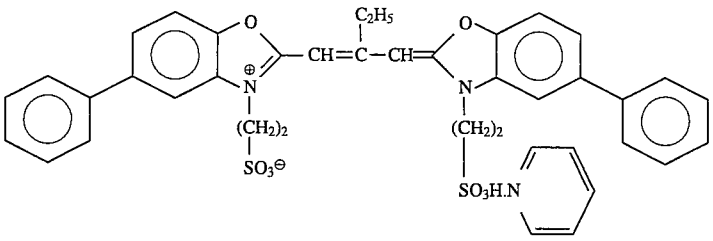 |
| ($4.0 \times 10^{-4}$ mol and $5.6 \times 10^{-4}$ mol respectively for the large- and small-size emulsions per mol of the silver halide) |
| and |
| sensitizing dye D |
| 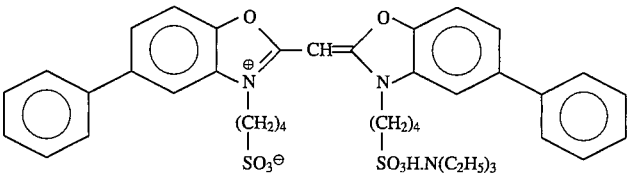 |
| ($7.0 \times 10^{-5}$ mol and $1.0 \times 10^{-5}$ mol respectively for the large- and small-size emulsions per mol of the silver halide) |

TABLE 8

| Red-sensitive emulsion layer |
|---|
| Sensitizing dye E |
| 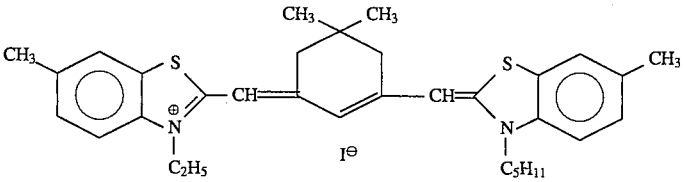 |
| ($0.9 \times 10^{-4}$ mol and $1.1 \times 10^{-4}$ mol respectively for the large- and small-size emulsions per mol of the silver halide) |
| In addition, the following compound was added in an amount of $2.6 \times 10^{-3}$ per mol of the silver halide. |
| 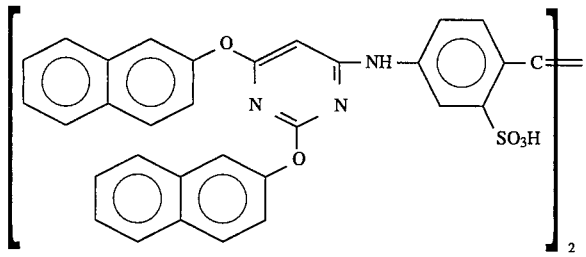 |

Further, 1-(5-methylureidophenyl)-5-mercaptotetrazole was added to the blue-, green-, and red-sensitive emulsion layers in amounts of $8.5\times10^{-5}$ mol, $7.7\times10^{-4}$ mol, and $2.5\times10^{4}$ mol per mol of the silver halide, respectively.

In addition, 4-hydroxy-6-methyl-1,3,3*a*, 7-tetrazaindene was added in amounts of $1\times10^{31\ 4}$ mol and $2\times10^{-4}$ mol per mol of the silver halide, respectively, to each of the blue- and green-sensitive emulsion layers.

Furthermore, the following dyes (coating amounts are represented in the parentheses) were added to the emulsion layers for anti-irradiation.

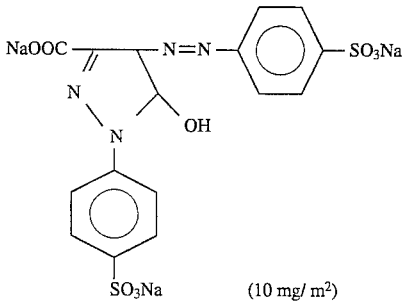

(10 mg/ m²)

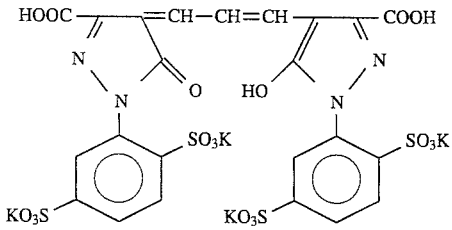

(10 mg/ m²)

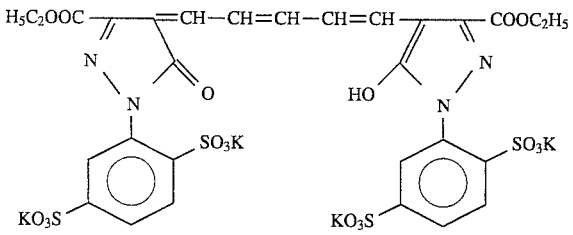

(40 mg/ m²)

and

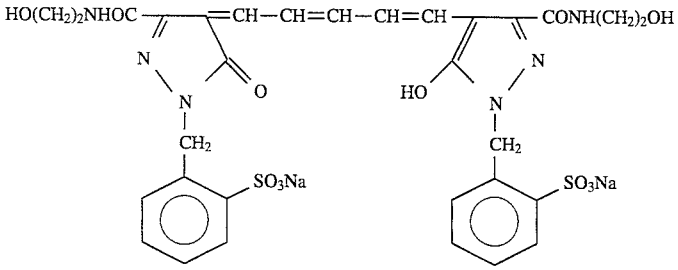

(20 mg/ m²)

(Layer arrangements)

The composition of each layer are shown in Tables 9 to 12 below, and the additives used are shown below the Table 12. The numerical values indicates the coating amount (g/m²). The coating of each silver halide emulsion is represented in terms of the amount of silver coated.

TABLE 9

| | |
|---|---|
| Support | |
| Polyethylene coated paper [containing a white pigment ($TiO_2$) and a blue dye (ultramarine blue) in polyethylene on the first layer side] | |
| First Layer (Blue-sensitive emulsion layer) | |
| Silver bromochloride emulsion (cubic, a 3:7 mixture (Ag molar ratio) of a large-size emulsion having having an average grain size of 0.88 μm and a small-size emulsion having an average grain size of 0.70 μm; the variation coefficients of grain-size distribution of the two emulsions being 0.08 and 0.10, respectively; each emulsion locally contained 0.3 mol % of silver bromide in a portion of the surface of each grain.) | 0.26 |
| Gelatin | 1.86 |
| Yellow coupler (ExY) | 0.64 |
| Dye image stabilizer (Cpd-1) | 0.19 |
| Solvent (Solv-1) | 0.32 |
| Dye image stabilizer (Cpd-7) | 0.06 |
| Dye image stabilizer (Cpd-9) | 0.04 |
| Stabilizer (Cpd-12) | 0.01 |

TABLE 10

| | |
|---|---|
| Second Layer (Color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third Layer (Green-sensitive emulsion layer) | |
| Silver bromochloride emulsion (cubic, a 1:3 mixture (Ag molar ratio) of a large-size emulsion having having an average grain size of 0.55 μm and a small-size emulsion having an average grain size of 0.39 μm; the variation coefficients of grain-size distribution of the two emulsions being 0.10 and 0.08, respectively; each emulsion locally containing 0.8 mol % of AgBr in a portion of the surface of each grain.) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |

TABLE 10-continued

| | |
|---|---|
| Dye image stabilizer (Cpd-4) | 0.02 |
| Dye image stabilizer (Cpd-9) | 0.02 |
| Solvent (Solv-2) | 0.40 |

TABLE 11

| | |
|---|---|
| Fourth Layer (Ultraviolet absorbing layer) | |
| Gelatin | 1.58 |
| Ultraviolet absorbent (UV-1) | 0.47 |
| Color mixing inhibitor (Cpd-5) | 0.05 |
| Solvent (Solv-3) | 0.06 |
| Solvent (Solv-5) | 0.20 |
| Fifth Layer (Red-sensitive emulsion layer) | |
| Sliver bromochloride emulsion (cubic, a 1:4 mixture (Ag molar ratio) of a large-size emulsion having having an average grain size of 0.58 μm and a small-size emulsion having an average grain size of 0.45 μm; the variation coefficients of grain-size distribution of the two emulsions being 0.09 and 0.11, respectively; each emulsion locally containing 0.6 mol % of AgBr in a portion of the surface of each grain.) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |

TABLE 12

| | |
|---|---|
| Sixth Layer (Ultraviolet absorbing layer) | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| Seventh Layer (Protective layer) | |
| Gelatin | 1.33 |
| Acryl-modified copolymer of polyvinyl alcohol (modification degree: 17%) | 0.17 |
| Liquid paraffin | 0.03 |

(ExY) yellow coupler

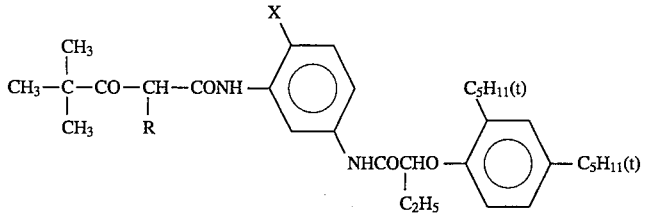

1:1 mixture (mole ratio) of

-continued
R =
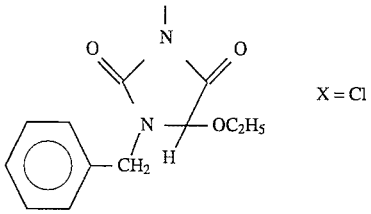
X = Cl
and
R =
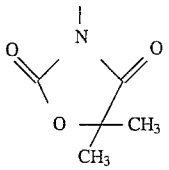
X = $OCH_3$
(ExM) magenta coupler
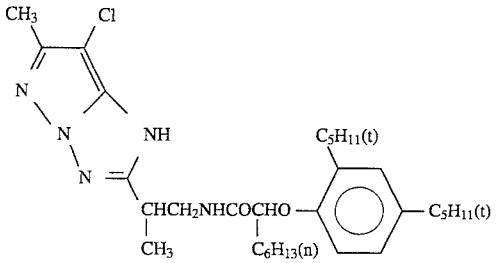
(ExC) cyan coupler
1:1 mixture (mole ratio) of
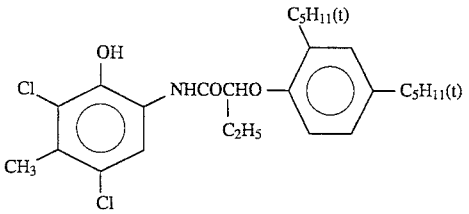
and
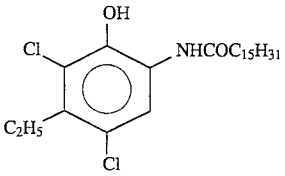
(Cpd-1) Dye image stabilizer
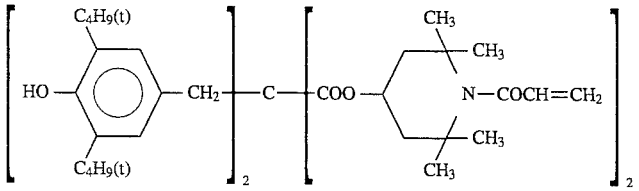

-continued
(Cpd-2) Dye image stabilizer
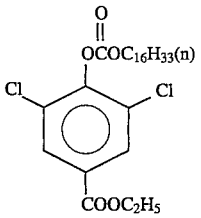
(Cpd-3) Dye image stabilizer
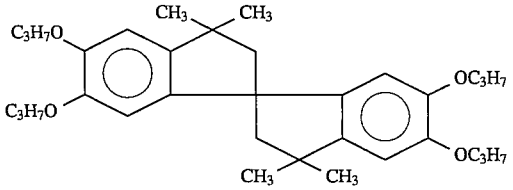
(Cpd-4) Dye image stabilizer
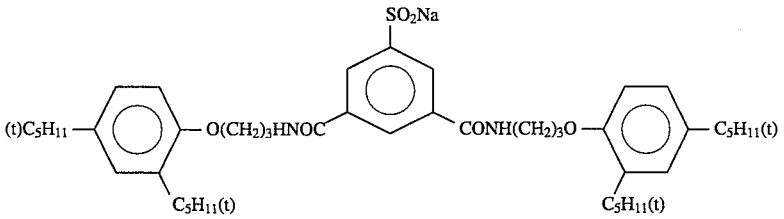
(Cpd-5) Color mixing inhibitor
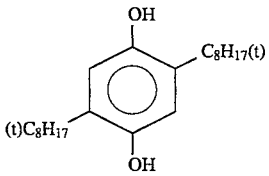
(Cpd-6) Dye image stabilizer
2:4:4 mixture (weight ratio) of
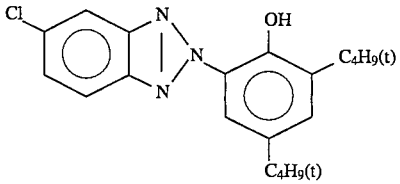
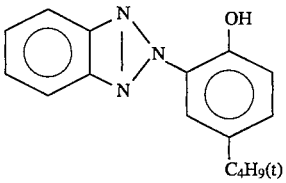
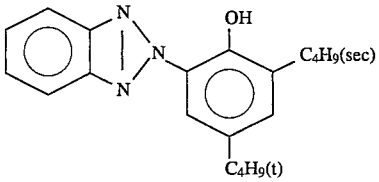

-continued
(Cpd-7) Dye image stabilizer
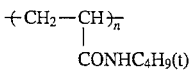
number-average molecular weight: 60,000
(Cpd-8) Dye image stabilizer
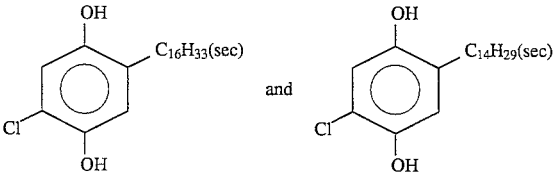
(Cpd-9) Dye image stabilizer
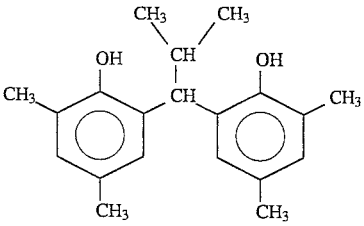
(Cpd-10) Antiseptic
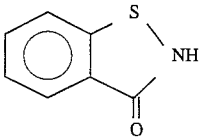
(Cpd-11) Antiseptic
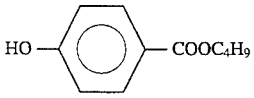
(Cpd-12) stabilizer
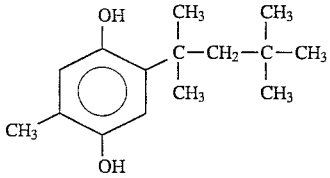
(UV-1) UV light absorbent
4:2:4 mixture (weight ratio) of
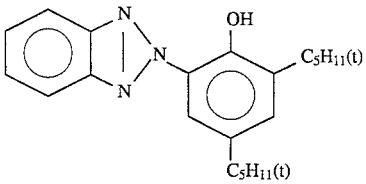

-continued
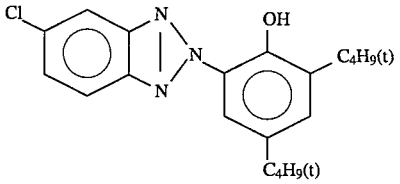
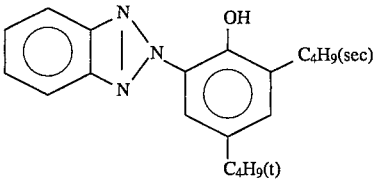
(H-1)
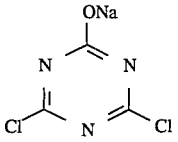
(H-2)
$CH_2{=}CH{-}SO_2{-}CH_2{-}CONH{-}CH_2$
$\quad\quad\quad -continued (Solv-6) solvent 80:20 mixture (volume ratio) of

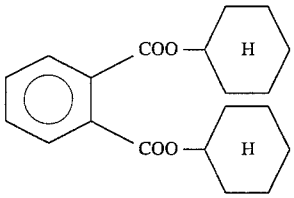

and $C_8H_{17}CHCH(CH_2)_7COOC_8H_{17}$
$\backslash\ /$
O

Next, samples 102 to 136 were prepared in which the couplers and high-boiling point organic solvent Solv-1, both used in the blue-sensitive emulsion layer of sample 101, were replaced by the couplers and high-boiling point organic solvents or the dispersing agents of the present invention, all specified in Tables 16 to 19 which will later be presented. In the case where the yellow coupler was Y-1, Y-20, or Y-18, the coating amount of the blue-sensitive layer was reduced to 80%, and in the case where the yellow coupler was Y-2, that amount was reduced to 90%.

The above samples were left to stand for 2 months at room temperature (about 20° C.), and then subjected to the following treatments.

First, each sample was subjected to wedge exposure to light through a sensitometric three-color separation filter, using a sensitometer (FWH type, light-source color temperature: 3200° K, manufactured by Fuji Photo Film, Co., Ltd.). This exposure was carried out with an exposure amount of 250 MCM. for 0.1 second.

By using a paper processor, the exposed samples were subjected to a continuous processing (running test), using the processing steps and solutions specified in Table 13 below, until the quantity of the replenisher became twice the volume of the tank used in the color development.

The compositions of the processing solutions are shown in Table 14 to 15 below.

TABLE 13

| Processing Step | Temperature | Time | Replenisher Amount* | Tank Volume |
|---|---|---|---|---|
| Color development | 35° C. | 45 sec. | 161 ml | 17 l |
| Bleach-fixing | 35° C. | 45 sec. | 215 ml | 17 l |
| Rinsing ① | 35° C. | 20 sec. | — | 10 l |
| Rinsing ② | 35° C. | 20 sec. | — | 10 l |
| Rinsing ③ | 35° C. | 20 sec. | 360 ml | 10 l |
| Drying | 80° C. | 60 sec. | | |

(*The replenisher amount in quantity per $m^2$ of the light-sensitive material.)
(A 3-tank counter flow system from rinsing ③ to ①)

TABLE 14

| Color Developing Solution | Tank solution | Replenisher |
|---|---|---|
| Water | 700 ml | 400 ml |
| Ethylenediamine tetraacetic acid | 3.0 g | 3.0 g |

TABLE 14-continued

| Color Developing Solution | Tank solution | Replenisher |
|---|---|---|
| Disodium 1,2-dihydroxybenzen-4,6-disulfonate | 0.5 g | 0.5 g |
| Triethanolamine | 12.0 g | 12.0 g |
| Potassium chloride | 1.6 g | — |
| Potassium bromide | 0.01 g | — |
| Potassium carbonate | 27.0 g | 27.0 g |
| Fluorescent brightener (WHITEX 4B, Sumitomo Chemical Co., Ltd.) | 1.0 gl | 2.5 g |
| Sodium sulfite | 0.1 g | 0.2 g |
| Disodium N,N-bis (sulfonatoethyl) hydroxylamine | 8.0 g | 10.0 g |
| N-ethyl-N-(β-methane-sulfonamidoethyl)-3-methyl-4-aminoaniline sulfate | 5.0 g | 7.1 g |
| Water to make: | 1000 ml | 1000 ml |
| pH (25° C.) | 10.05 | 10.45 |

TABLE 15

| Bleach-Fixing Solution (the tank solution and the replenisher are identical.) | |
|---|---|
| Water | 600 ml |
| Ammonium thiosulfate (700 g/l) | 100 ml |
| Ammonium iron(III) ethylenediamine-teteraacetate | 55 g |
| Ethylenediaminetetraacetic acid | 5 g |
| Ammonium bromide | 40 g |
| Nitric acid (67%) | 30 g |
| Water to make: | 1000 ml |
| pH (25° C.) (by acetic acid and ammonium water) | 5.8 |
| Rinsing Solution (the tank solution and the replenisher are identical.) | |
| Ion exchange water (calcium and magnesium are each 3 ppm or less) | |

The results of the measurements of the samples after the processing, made for their yellow color-forming densities ($D_{max}$) and their fog densities ($D_{min}$) are shown in Tables 16 to 19 below. Also shown in Tables 16 to 19 are the fog densities $D_{min}$ where the time of the color development was prolonged to 90 seconds.

TABLE 16

| Sample No. | Coupler | High-boiling point solvent or dispersant of the invention | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 101 | ExY | Solv-1 | 2.42 | 0.08 | 0.15 | 74% | 76% | Comp. |
| 102 | " | Solv-3 | 2.32 | 0.07 | 0.13 | 72% | 73% | " |
| 103 | " | Solv-4 | 2.35 | 0.08 | 0.14 | 76% | 77% | " |
| 104 | " | E-1 | 2.40 | 0.09 | 0.17 | 88% | 85% | " |
| 105 | " | A-19 (60%) Solv-1 (40%) | 2.80 | 0.08 | 0.14 | 86% | 78% | " |
| 106 | " | S-4 | 1.83 | 0.08 | 0.14 | 85% | 79% | " |
| 107 | " | S-21 | 1.74 | 0.07 | 0.13 | 89% | 81% | " |
| 108 | " | S-34 | 1.32 | 0.07 | 0.13 | — | — | " |
| 109 | " | S-35 | 1.97 | 0.08 | 0.14 | 83% | 80% | " |

TABLE 17

| Sample No. | Coupler | Dispersant | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 110 | Y-1 | Solv-1 | 2.45 | 0.11 | 0.27 | 54% | 63% | Comp. |
| 111 | " | Solv-3 | 2.40 | 0.10 | 0.24 | 52% | 69% | " |
| 112 | " | Solv-4 | 2.42 | 0.10 | 0.25 | 55% | 65% | " |
| 113 | " | E-1 | 2.41 | 0.09 | 0.16 | 85% | 82% | Invention |
| 114 | " | A-19 (60%) Solv-1 (40%) | 2.40 | 0.08 | 0.14 | 82% | 78% | Invention |
| 115 | " | S-4 | 2.38 | 0.08 | 0.15 | 78% | 77% | Invention |
| 116 | " | S-21 | 2.37 | 0.08 | 0.14 | 80% | 79% | Invention |
| 117 | " | S-34 | 2.36 | 0.07 | 0.13 | 83% | 80% | Invention |
| 118 | " | S-35 | 2.40 | 0.08 | 0.15 | 79% | 76% | Invention |

TABLE 18

| Sample No. | Coupler | Dispersant | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 119 | Y-20 | Solv-1 | 2.42 | 0.11 | 0.26 | 52% | 62% | Comp. |
| 120 | " | E-1 | 2.41 | 0.09 | 0.15 | 79% | 81% | Invention |
| 121 | " | A-19 (60%) Solv-1 (40%) | 2.39 | 0.08 | 0.14 | 80% | 79% | Invention |
| 122 | " | S-21 | 2.37 | 0.08 | 0.14 | 82% | 77% | Invention |
| 123 | " | S-34 | 2.39 | 0.07 | 0.13 | 81% | 77% | Invention |
| 124 | Y-18 | Solv-1 | 2.39 | 0.10 | 0.22 | 63% | 83% | Comp. |
| 125 | " | E-1 | 2.40 | 0.08 | 0.14 | 86% | 93% | Invention |
| 126 | " | A-19 (60%) | 2.36 | 0.08 | 0.14 | 83% | 88% | Inven- |

TABLE 18-continued

| Sample No. | Coupler | Dispersant | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 127 | " | Solv-1 (40%) S-21 | 2.31 | 0.07 | 0.13 | 84% | 90% | tion Inven-tion |

TABLE 19

| Sample No. | Coupler | Dispersant | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 128 | Y-18 | S-34 | 2.33 | 0.07 | 0.13 | 82% | 89% | Inven-tion |
| 129 | Y-2 | Solv-1 | 2.43 | 0.12 | 0.33 | 48% | 28% | Comp. |
| 130 | " | E-1 | 2.42 | 0.10 | 0.19 | 74% | 68% | Inven-tion |
| 131 | " | A-19 (60%) Solv-1 (40%) | 2.39 | 0.09 | 0.17 | 76% | 52% | Inven-tion |
| 132 | " | S-21 | 2.31 | 0.09 | 0.17 | 75% | 45% | Inven-tion |
| 133 | Y-3 | Solv-1 | 2.42 | 0.09 | 0.18 | 69% | 72% | Comp. |
| 134 | " | E-1 | 2.39 | 0.08 | 0.15 | 83% | 81% | Inven-tion |
| 135 | " | A-19 (60%) Solv-1 (40%) | 2.31 | 0.08 | 0.14 | 85% | 79% | Inven-tion |
| 136 | " | S-21 | 2.17 | 0.07 | 0.13 | 87% | 80% | Inven-tion |

The compounds of formula (II) slightly increased fog when combined with the comparative couplers, but reduced fog when combined with the couplers of the present invention. The improvement in reduced fog was significant when the development time was long.

Further, it is evident from these results that, when combined with the compound of formula (III) or the ester of the present invention having a melting point of 25° C. or more at normal pressure, the comparative couplers lower the color-forming density ($D_{max}$), but the yellow couplers of the present invention can reduce fog without significantly lowering the color-forming density.

Tables 16 to 19 also show the ratio of remaining color image which was measured after the sample had been exposed to the light from a 76,000-lux xenon lamp for four days. Also they show the ratio of remaining color image, which was measured after the sample had been left to stand for 3 months at 60° C. - 70%. From these results, it is evident that the compounds of formula (II) or (III), or the esters of the present invention provide a discoloration improving effect even with the comparative couplers to some extent, but the effect is much more significant with the couplers of the present invention, so that the discoloration is improved to a practically sufficient level.

EXAMPLE 2

Sample 201 was prepared in the same way as sample 101 described in Example 1. Likewise, samples 202 to 236 were prepared in which the coupler and the high boiling point organic solvent used in sample 101 were replaced by the compounds specified in Tables 20 to 23, provided that either part or whole of the high-boiling solvent Solv-1 was replaced at the ratio specified in Tables 20 to 23 replaced. In this case, substantially the same results were obtained as in Example 1, as shown in Table 20 to 23.

TABLE 20

| Sample No. | Coupler | Co-dispersed Compound Type | Co-dispersed Compound Amount added | Dmax 45 sec. processing | Dmin 45 sec. processing | Dmin 90 sec. processing | Remark |
|---|---|---|---|---|---|---|---|
| 201 | ExY | Solv-1 | — | 2.42 | 0.08 | 0.15 | Comp. |
| 202 | " | E-1 | 50% | 2.42 | 0.09 | 0.16 | " |
| 203 | " | " | 80% | 2.40 | 0.09 | 0.17 | " |
| 204 | " | " | 100% | 2.37 | 0.09 | 0.17 | " |
| 205 | " | E-4 | 80% | 2.35 | 0.08 | 0.16 | " |
| 206 | " | E-16 | 80% | 2.38 | 0.09 | 0.18 | " |
| 207 | " | A-19 | 40% | 2.19 | 0.09 | 0.16 | " |
| 208 | " | " | 60% | 2.08 | 0.08 | 0.14 | " |
| 209 | " | " | 80% | 1.74 | 0.08 | 0.13 | " |

TABLE 21

| Sample No. | Coupler | Co-dispersed Compound Type | Co-dispersed Compound Amount added | Dmax 45 sec. processing | Dmin 45 sec. processing | Dmin 90 sec. processing | Remark |
|---|---|---|---|---|---|---|---|
| 210 | ExY | A-5 | 60% | 2.01 | 0.08 | 0.14 | Comp. |
| 211 | " | A-20 | 60% | 1.98 | 0.07 | 0.13 | " |
| 212 | " | S-21 | 50% | 2.04 | 0.08 | 0.15 | " |
| 213 | " | " | 80% | 1.74 | 0.07 | 0.13 | " |
| 214 | " | " | 100% | 1.35 | 0.07 | 0.13 | " |
| 215 | Y-1 | Solv-1 | 100% | 2.45 | 0.11 | 0.27 | " |
| 216 | " | E-1 | 50% | 2.44 | 0.10 | 0.21 | Invention |
| 217 | " | " | 80% | 2.41 | 0.09 | 0.16 | Invention |
| 218 | " | " | 100% | 2.38 | 0.09 | 0.17 | Invention |

TABLE 22

| Sample No. | Coupler | Co-dispersed Compound Type | Co-dispersed Compound Amount added | Dmax 45 sec. processing | Dmin 45 sec. processing | Dmin 90 sec. processing | Remark |
|---|---|---|---|---|---|---|---|
| 219 | Y-1 | E-1 | 80% | 2.36 | 0.10 | 0.18 | Invention |
| 220 | " | E-16 | 80% | 2.33 | 0.09 | 0.17 | Invention |
| 221 | " | A-1 | 40% | 2.43 | 0.10 | 0.19 | Invention |
| 222 | " | " | 60% | 2.40 | 0.08 | 0.14 | Invention |
| 223 | " | " | 80% | 2.41 | 0.08 | 0.14 | Invention |
| 224 | " | A-5 | 60% | 2.37 | 0.09 | 0.16 | Invention |
| 225 | " | A-20 | 60% | 2.36 | 0.08 | 0.15 | Invention |
| 226 | " | S-21 | 50% | 2.40 | 0.09 | 0.15 | Invention |
| 227 | " | " | 80% | 2.37 | 0.08 | 0.14 | Invention |

TABLE 23

| Sample No. | Coupler | Co-dispersed Compound Type | Co-dispersed Compound Amount added | Dmax 45 sec. processing | Dmin 45 sec. processing | Dmin 90 sec. processing | Remark |
|---|---|---|---|---|---|---|---|
| 228 | Y-1 | S-20 | 100% | 2.24 | 0.08 | 0.13 | Invention |
| 229 | " | S-34 | 50% | 2.41 | 0.09 | 0.16 | Invention |
| 230 | " | " | 80% | 2.36 | 0.07 | 0.13 | Invention |
| 231 | " | " | 100% | 2.21 | 0.07 | 0.12 | Invention |
| 232 | " | S-2 | 80% | 2.32 | 0.08 | 0.14 | Invention |
| 233 | " | S-7 | " | 2.29 | 0.08 | 0.14 | Invention |
| 234 | " | S-18 | " | 2.31 | 0.08 | 0.14 | Invention |
| 235 | " | S-33 | " | 2.35 | 0.09 | 0.15 | Invention |
| 236 | " | S-36 | " | 2.37 | 0.09 | 0.16 | Invention |

EXAMPLE 3

With hindered phenol HP-5 being used in place of the dye image stabilizer Cpd-9, the same evaluation procedures were taken as in Example 1. In this case, substantially the same results were obtained as in Example 1.

EXAMPLE 4

After corona discharge treatment was performed on the surface of a paper support, both surfaces of which had been laminated with polyethylene layers, a gelatin undercoating layer containing sodium dodecylbenzenesulfonate was formed on the support. Further, various photographic layers were coated on the support, thereby preparing a multilayer color photographic paper (sample 301). The coating solutions were prepared as follows.

Preparation of Coating Solution of First Layer 153.0 g of the yellow coupler (ExY), 15.0 g of the dye image stabilizer (Cpd-7), 7.5 g of the dye image stabilizer (Cpd-9), 16.0 g of the dye image stabilizer (Cpd-13) were dissolved in 25 g of the solvent (Solv-7), 25 g of the solvent (Solv-1), and 180 cc of ethyl acetate. This solution was emulsified and dispersed in 1000 g of 20% aqueous gelatin solution containing 60 cc of 10% sodium dodecylbenzenesulfonate and 10 g of citric acid, thereby preparing an emulsified dispersion A. In the meantime, a silver bromochloride emulsion A (cubic, a 3:7 mixture (Ag molar ratio) of a large-size emulsion A having an average size of 0.88 μm and a small-size emulsion A having an average size of 0.70 μm. The variation coefficients of the grain size distributions were 0.08 and 0.10, respectively, and each locally contained 0.3 mol % of AgBr in a portion of the surface of each grain) was prepared. The blue-sensitive sensitizing dyes A and B noted below had been added to the large-size emulsion, each in an amount of $2.0\times10^{-4}$ mol, and also to the small-size emulsion, each in an amount of $2.5\times10^{-4}$ mol. The chemical ripening of this emulsion had been carried out with the addition of a sulfur sensitizer and a gold sensitizer. Thereafter, the emulsified dispersion A and the silver bromochloride emulsion A were mixed and dissolved in each other, thereby preparing the first coating solution, the composition of which was as will be described below.

Coating solutions of the second to seventh layers were prepared in the same way as the coating solution of the first layer. 1-oxy-3,5-dichloro-s-triazine sodium salt was used as a gelatin hardener for each layer.

Cpd-10 and Cpd-11 were added to each layer such that their total amounts used were 25.0 mg/m$^2$ and 50 mg/m$^2$, respectively.

The spectral sensitizing dye and the supersensitizer, both identical to those described in Tables 6 to 8, were used in the silver bromochloride emulsion of each light-sensitive emulsion layer.

Also, 1-(5-methylureidophenyl)-5-mercaptotetrazole was added to the blue-, green-, and red-sensitive emulsion layers, in amounts of $8.5\times10^{-5}$ mol, $7.7\times10^{-4}$ mol, and $2.5\times10^{-4}$ mol per mol of silver halide, respectively.

Further, 4-hydroxy-6-methyl-1,3,3*a*, 7-tetrazaindene was added to the blue- and green-sensitive emulsion layers, in amounts of $1\times10^{-4}$ mol and $2\times10^{-4}$ mol per mol of silver halide, respectively.

In addition, the above-described four were added for anti-irradiation (in the same coating amounts).

(Layer Arrangements)

The composition of each layer is shown in Tables 24 to 27 below. The numerical values indicates the coating amount ($g/m^2$). The coating of each silver halide emulsion is represented in terms of the amount of silver coated. Also, the compounds used are specified below the Table 27.

TABLE 24

| | |
|---|---|
| Support | |
| Polyethylene laminated paper [containing a white pigment ($TiO_2$) and a blue dye (ultramarine blue) in polyethylene on the first layer side] | |
| First Layer (Blue-sensitive emulsion layer) | |
| Silver bromochloride emulsion A | 0.27 |
| Gelatin | 1.36 |
| Yellow coupler (ExY) | 0.70 |
| Dye image stabilizer (Cpd-7) | 0.08 |
| Dye image stabilizer (Cpd-9) | 0.04 |
| Dye image stabilizer (Cpd-13) | 0.08 |
| Solvent (Solv-1) | 0.26 |
| Second Layer (Color mixing inhibiting layer) | |
| Gelatin | 1.00 |
| Color mixing inhibitor (Cpd-5) | 0.06 |
| Solvent (Solv-11) | 0.03 |
| Solvent (Solv-1) | 0.25 |
| Solvent (Solv-4) | 0.25 |

TABLE 25

| | |
|---|---|
| Third Layer (Green-sensitive emulsion layer) | |
| Silver bromochloride emulsion (cubic, a 1:3 mixture (Ag molar ratio) of a large-size emulsion B having having an average grain size of 0.55 μm and a small-size emulsion B having an average grain size of 0.39 μm; the variation coefficients of grain-size distribution of the two emulsions being 0.10 and 0.08, respectively; each emulsion locally containing 0.8 mol % of AgBr in a portion of the surface of each grain.) | 0.13 |
| Gelatin | 1.45 |
| Magenta coupler (ExM) | 0.16 |
| Dye image stabilizer (Cpd-3) | 0.15 |
| Dye image stabilizer (Cpd-9) | 0.03 |
| Dye image stabilizer (Cpd-14) | 0.01 |
| Dye image stabilizer (Cpd-15) | 0.01 |
| Dye image stabilizer (Cpd-2) | 0.08 |
| Solvent (Solv-4) | 0.50 |
| Solvent (Solv-8) | 0.15 |
| Solvent (Solv-9) | 0.15 |
| Fourth Layer (Color mixing inhibiting layer) | |
| Gelatin | 0.70 |
| Color mixing inhibitor (Cpd-5) | 0.04 |
| Solvent (Solv-11) | 0.02 |
| Solvent (Solv-1) | 0.18 |
| Solvent (Solv-4) | 0.18 |

TABLE 26

| | |
|---|---|
| Fifth Layer (Red-sensitive emulsion layer) | |
| Sliver bromochloride emulsion (cubic, a 1:4 mixture (Ag molar ratio) of a large-size emulsion C having having an average grain size of 0.50 μm and a small-size emulsion C having an average grain size of 0.41 μm; the variation coefficients of grain-size distribution of the two emulsions being 0.09 and 0.11, respectively; each emulsion locally containing 0.8 mol % of AgBr in a portion of the surface of each grain.) | 0.20 |
| Gelatin | 0.85 |
| Cyan coupler (ExCl) | 0.33 |
| Ultraviolet absorbent (UV-3) | 0.18 |
| Dye image stabilizer (Cpd-16) | 0.15 |
| Dye image stabilizer (Cpd-17) | 0.15 |
| Dye image stabilizer (Cpd-18) | 0.01 |
| Solvent (Solv-10) | 0.22 |
| Dye image stabilizer (Cpd-2) | 0.01 |
| Dye image stabilizer (Cpd-14) | 0.01 |
| Dye image stabilizer (Cpd-7) | 0.30 |
| Solvent (Solv-7) | 0.01 |
| Sixth Layer (Ultraviolet absorbing layer) | |
| Gelatin | 0.55 |
| Ultraviolet absorbent (UV-2) | 0.38 |
| Dye image stabilizer (Cpd-19) | 0.15 |
| Dye image stabilizer (Cpd-3) | 0.02 |

TABLE 27

| | |
|---|---|
| Seventh Layer (Protective layer) | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-20) | 0.01 |

(ExC1) cyan coupler

3:7 mixture (mole ratio) of

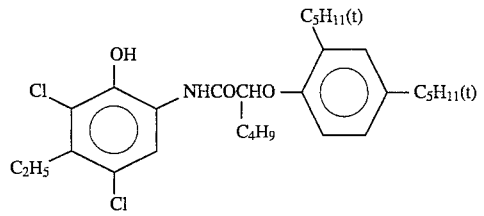

and

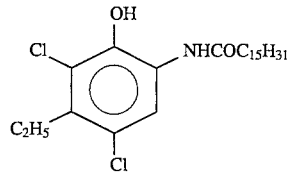

-continued
(Cpd-13) Dye image stabilizer
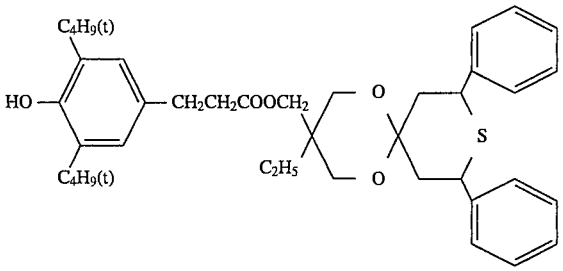
(Cpd-14) Dye image stabilizer
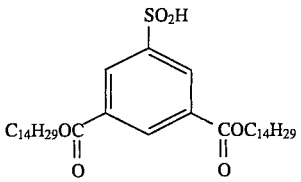
(Cpd-15) Dye image stabilizer
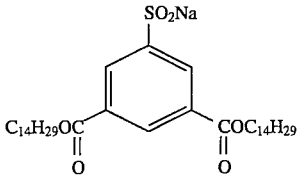
(Cpd-16) Dye umage stabilizer
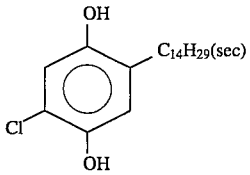
(Cpd-17) Dye image stabilizer
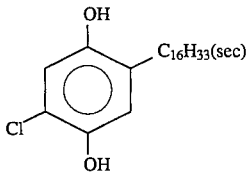
(Cpd-18)
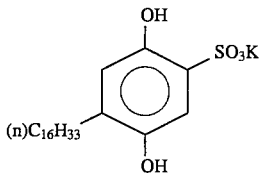
(Cpd-19)
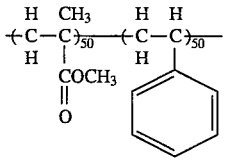
number-average molecular weight: 60,000
-continued
(Cpd-20)
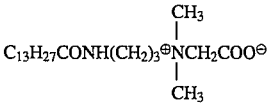
(UV-2) UV light absorber
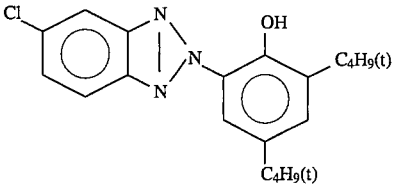
(1)
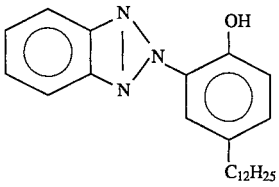
(2)
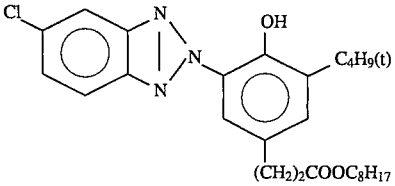
(3)
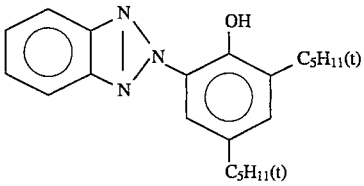
(4)
A 10:5:1:5 mixture (weight ratio) of (1), (2), (3) and (4)
(UV-3) UV light absorber
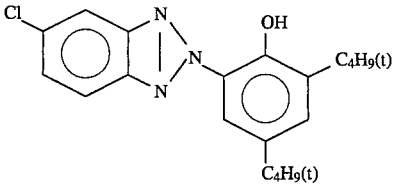
(5)
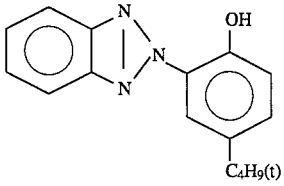
(6)
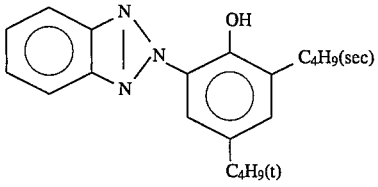
A 1:2:2: mixture (weight ratio) of (5), (6) and (7)

-continued (Solv-7) solvent

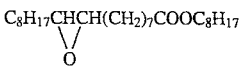

(Solv-8) solvent

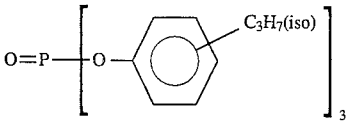

(Solv-9) solvent

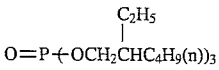

(Solv-10) solvent

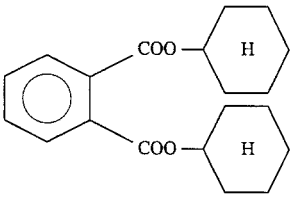

(Solv-11) solvent

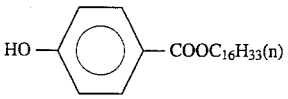

Sample 301 was subjected to gray exposure, using a sensitometer (FWH-type, light-source color temperature: 3200° K, manufactured by Fuji Photo Film, Co., Ltd.), such that about 30% of the silver coated was developed.

The exposed sample was continuously processed by means of a paper processor, using the same steps and the same processing solutions as in Example 1. As a result, the processing solutions having running-equilibrium condition were prepared.

Samples 302 to 340 were prepared in which the coupler and high-boiling point organic solvent (Solv-1) in the blue-sensitive emulsion layer of sample 301 were replaced by the couplers and high-boiling point organic solvents or the dispersants of the invention as shown in Tables 28 to 31 below, provided that, in the case where the yellow coupler was Y-1, Y-18, or Y-31, the coating amount of the blue sensitive layer was reduced to 80%.

The above samples were left to stand for 2 months at room temperature (about 20° C.) and then subjected to the following treatments.

First, each sample was subjected to wedge exposure to light, using a sensitometer (FWH-type, light-source color temperature: 3200° K, manufactured by Fuji Photo Film, Co., Ltd.), through a sensitometric three-color separation filter. This exposure was carried out for 0.1 second, at an exposure amount of 250 MCM.

The exposed samples were continuously processed (running test) by means of a paper processor, using the same steps and the same processing solutions as in Example 1, until the quantity of a replenisher became twice the volume of the tank used in the color development.

The results of the measurements of yellow color-forming densities ($D_{max}$) and fog densities ($D_{min}$) are shown in Tables 28 to 31. Also shown in Tables 28 to 31 are the fog densities $D_{min}$ in cases where the time of the color development was prolonged to 90 seconds.

It is seen that the compounds of formula (II) slightly increased fog when combined with the comparative couplers, but reduced fog when combined with the couplers of the present invention. The improvement in reduced fog was significant when the development time was long.

Tables 28 to 31 also show the ratio of remaining color image, which was measured after the image had been intermittently exposed to the light from a 76,000-lux xenon lamp for four days, each time exposed for 5 hours and then kept in a dark room for 1 hour. Also they show the ratio of remaining color image of the sample, which was measured after the image had been left to stand for 3 months under the condition of 60° C. - 70%. From these results it is evident that the compounds of formula (II) or (III) provide a discoloration-improving effect even with the comparative coupler to some extent, but the effect is much more significant with the couplers of the present invention, so that the discoloration is improved to a practically sufficient improvement level. Further, when Y-35 or Y-36 of was used as a yellow coupler of the invention, similarly advantageous effect was obtained.

TABLE 28

| Sample No. | Coupler | High-boiling point solvent or compound of the invention | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 301 | ExY | Solv-1 | 2.38 | 0.09 | 0.16 | 73% | 75% | Comp. |
| 302 | " | Solv-4 | 2.32 | 0.08 | 0.14 | 71% | 74% | " |
| 303 | " | Solv-9 | 2.24 | 0.07 | 0.13 | 75% | 76% | " |
| 304 | " | Solv-7 | 2.41 | 0.10 | 0.19 | 78% | 83% | " |
| 305 | " | Solv-1 (100%) E-21 (10%) | 2.36 | 0.11 | 0.17 | 81% | 81% | " |
| 306 | " | Solv-1 (100%) E-23 (10%) | 2.35 | 0.10 | 0.16 | 80% | 83% | " |
| 307 | " | Solv-7 (100%) E-21 (10%) | 2.39 | 0.11 | 0.18 | 80% | 84% | " |
| 308 | " | Solv-7 (100%) E-21 (20%) | 2.37 | 0.11 | 0.18 | 82% | 86% | " |

TABLE 29

| Sample No. | Coupler | High-boiling point solvent or compound of the invention | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 309 | Y-1 | Solv-1 | 2.35 | 0.12 | 0.26 | 55% | 52% | Comp. |
| 310 | " | Solv-4 | 2.32 | 0.11 | 0.25 | 51% | 55% | " |
| 311 | " | Solv-9 | 2.24 | 0.10 | 0.23 | 47% | 54% | " |
| 312 | " | Solv-7 | 2.41 | 0.08 | 0.15 | 78% | 73% | Invention |
| 313 | " | Solv-1 (100%) E-21 (10%) | 2.37 | 0.09 | 0.17 | 81% | 80% | Invention |
| 314 | " | Solv-1 (100%) E-23 (10%) | 2.35 | 0.09 | 0.15 | 80% | 78% | Invention |
| 315 | Y-1 | Solv-7 (100%) E-21 (10%) | 2.41 | 0.08 | 0.14 | 82% | 84% | Invention |
| 316 | " | Solv-7 (100%) E-21 (20%) | 2.39 | 0.08 | 0.13 | 85% | 88% | Invention |
| 317 | Y-18 | Solv-1 | 2.41 | 0.12 | 0.25 | 50% | 78% | Comp. |
| 318 | " | Solv-4 | 2.37 | 0.12 | 0.24 | 49% | 77% | " |
| 319 | " | Solv-9 | 2.32 | 0.10 | 0.23 | 47% | 75% | " |
| 320 | " | Solv-7 | 2.45 | 0.08 | 0.15 | 76% | 91% | Invention |
| 321 | " | Solv-1 (100%) E-21 (10%) | 2.38 | 0.09 | 0.16 | 79% | 89% | Invention |

TABLE 30

| Sample No. | Coupler | Dispersant or compound of the invention | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 322 | Y-18 | Solv-1 (100%) E-23 (10%) | 2.36 | 0.09 | 0.16 | 78% | 90% | Invention |
| 323 | " | Solv-7 (100%) E-21 (10%) | 2.43 | 0.08 | 0.13 | 80% | 93% | Invention |
| 324 | " | Solv-7 (100%) E-21 (20%) | 2.41 | 0.08 | 0.12 | 82% | 95% | Invention |
| 325 | Y-31 | Solv-1 | 2.45 | 0.11 | 0.24 | 52% | 75% | Comp. |
| 326 | " | Solv-4 | 2.41 | 0.12 | 0.22 | 51% | 76% | " |
| 327 | " | Solv-9 | 2.37 | 0.10 | 0.20 | 50% | 73% | " |
| 328 | Y-31 | Solv-7 | 2.45 | 0.08 | 0.14 | 79% | 89% | Invention |
| 329 | " | Solv-1 (100%) E-21 (10%) | 2.42 | 0.09 | 0.16 | 80% | 86% | Invention |
| 330 | " | Solv-1 (100%) E-20 (10%) | 2.39 | 0.09 | 0.15 | 76% | 74% | Invention |
| 331 | " | Solv-7 (50%) Solv-1 (50%) E-21 (10%) | 2.46 | 0.08 | 0.12 | 82% | 92% | Invention |
| 332 | " | Solv-7 (50%) Solv-1 (50%) E-21 (20%) | 2.44 | 0.08 | 0.11 | 84% | 94% | Invention |

TABLE 31

| Sample No. | Coupler | Dispersant or compound of the invention | Maximum color-forming density Dmax | Minimum color-forming density 45 sec. processing | Minimum color-forming density 90 sec. processing | Discoloration (remaining color image ratio) Light (Xe light source) | Discoloration (remaining color image ratio) Heat (60° C. · 70%) | Remark |
|---|---|---|---|---|---|---|---|---|
| 333 | Y-18 | Solv-1 (50%) A-25 (50%) | 2.35 | 0.08 | 0.13 | 86% | 92% | Invention |
| 334 | " | Solv-1 (100%) A-25 (50%) | 2.38 | 0.09 | 0.15 | 82% | 94% | Invention |
| 335 | " | Solv-1 (50%) A-28 (50%) | 2.40 | 0.07 | 0.12 | 87% | 93% | Invention |
| 336 | " | Solv-1 (100%) A-28 (50%) | 2.45 | 0.08 | 0.14 | 85% | 92% | Invention |
| 337 | " | Solv-4 (50%) A-28 (50%) | 2.36 | 0.07 | 0.12 | 89% | 94% | Invention |
| 338 | " | Solv-4 (100%) A-28 (50%) | 2.38 | 0.08 | 0.13 | 86% | 93% | Invention |
| 339 | " | Solv-1 (100%) A-29 (25%) | 2.37 | 0.09 | 0.15 | 79% | 89% | Invention |
| 340 | " | Solv-1 (100%) A-29 (50%) | 2.32 | 0.08 | 0.13 | 83% | 91% | Invention |

According to the present invention, a color photographic light-sensitive material can be provided which excels not only in color reproducibility but also in color image storage stability against light or heat, with the use of small amounts of couplers and silver. The color photographic light-sensitive material of the invention has a great advantage in that it can remarkably prevent the fog formation during color development, paticularly during a running state.

What is claimed is:

1. A multilayer silver halide color light-sensitive material which comprises a yellow color-forming silver halide emulsion layer, a magenta color-forming silver halide emulsion layer, and a cyan color-forming silver halide emulsion layer, on a support, said yellow color-forming silver halide emulsion layer containing at least one acylacetamide-type yellow coupler having an acyl group represented by the following formula (I) and at least one ester having a melting point of 25° C. or more at normal pressure and a molecular weight of 1000 or less:

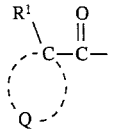

Formula (I)

wherein $R^1$ is an alkyl group, an aryl group or a halogen atom, Q is a non-metallic atomic group required to form, together with C, a 3- to 5-membered hydrocarbon ring or a 3- to 5-membered heterocyclic ring having at least one hetero atom selected from the group consisting of N, S, O and P in the ring, provided that $R^1$ does not bond to Q to form a ring.

2. The light-sensitive material according to claim 1, wherein said acylacetamide-type yellow coupler is contained in an amount of 0.1 to 2.0 mmol/$m^2$.

3. The light-sensitive material according to claim 1, wherein said at least one ester is contained in a weight ratio of 0.1 to 2.0 with respect to a total amount of all yellow couplers.

4. The light-sensitive material according to claim 1, wherein said acylacetamide-type yellow coupler is represented by the following formula (Y):

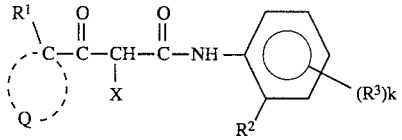

where $R^1$ is an alkyl group, an aryl group or a halogen atom; Q represents a nonmetallic atomic group required to form, together with C, a 3- to 5-membered hydrocarbon ring or a 3- to 5-membered heterocyclic ring containing at least one hetero atom selected from N, S, O and P in the ring; $R^2$ represents a hydrogen atom, a halogen atom, an alkoxy group, an aryloxy group, an alkyl group, or an amino group; $R^3$ represents a group which can be substituted on the benzene ring; X represents a hydrogen atom, or a group which can be split off upon a coupling reaction with an oxidized form of an aromatic primary amine developing agent; and k represents an integer of 0 to 4, and when k is 2 to 4, the plural $R^3$'s are either the same or different.

5. The light sensitive material according to claim 1, wherein said $R^1$ in the formula (I) is a halogen atom or an alkyl group having a total of 1 to 30 carbon atoms, or an aryl group having a total of 6 to 30 carbon atoms.

6. The light-sensitive material according to claim 4, wherein said $R^3$ in the formula (Y) is a halogen atom, an alkyl group having a total of 1 to 30 carbon atoms, an aryl group having a total of 6 to 30 carbon atoms, an alkoxy group having a total of 1 to 30 carbon atoms, an alkoxycarbonyl group having a total of 2 to 30 carbon atoms, an aryloxycarbonyl group having a total of 7 to 30 carbon atoms, a carbonamido group having a total of 1 to 30 carbon atoms, a sulfonamido group having a total of 1 to 30 carbon atoms, a carbamoyl group having a total of 1 to 30 carbon atoms, a sulfamoyl group having a total of 0 to 30 carbon atoms, an alkylsulfonyl group having a total of 1 to 30 carbon atoms, an arylsulfonyl group having a total of 6 to 30 carbon atoms, a ureido group having a total of 1 to 30 carbon atoms, a sulfamoylamino group having a total of 0 to 30 carbon atoms, an alkoxycarbonylamino group having a total of 2 to 30 carbon atoms, a heterocyclic group having a total of 1 to 30 carbon atoms, an acyl group having a total of 1 to 30 carbon atoms, an alkylsulfonyloxy group having a total of 1 to 30 carbon atoms, or arylsulfonyloxy group having a total of 6 to 30 carbon atoms.

7. The light-sensitive material according to claim 4, wherein said Q is a non-metallic atomic group required to form, together with C, a 3- to 5-membered hydrocarbon ring having a total of 3 to 30 carbon atoms, or a 3- to 5-membered heterocyclic ring having at least one heteroatom selected from N, S, O and P in the ring, and having a total of 2 to 30 carbon atoms.

8. The light-sensitive material according to claim 1, wherein said yellow color-forming silver halide emulsion layer contains silver chloride or silver bromochloride having a silver chloride content of 90 mol % or more.

9. The light-sensitive material according to claim 1, wherein said at least one ester is selected from the group consisting of aliphatic carboxylic acid esters, aromatic carboxylic acid esters and phosphoric acid esters.

10. The light-sensitive material according to claim 1, wherein the melting point at normal pressure of said at least one ester is 25° C. to 200° C.

11. The light-sensitive material according to claim 1, wherein the molecular weight of said at least one ester is 150 to 1000.

12. The light-sensitive material according to claim 1, wherein said at least one ester is represented by the following formulas (1), (2), (3) or (4):

$$R^1-COO-R^2 \qquad \text{Formula (1)}$$

Formula (2)

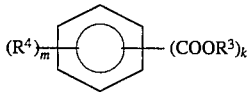

-continued

Formula (3)

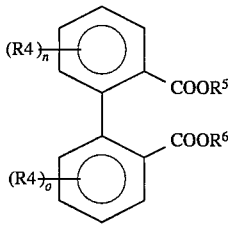

Formula (4)

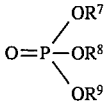

wherein $R^1$ is a straight chain or branched chain alkyl group having a total of 1 to 36 carbon atoms, or a cycloalkyl group having a total of 3 to 36 carbon atoms; $R^2$, $R^3$, $R^5$, $R^6$, $R^7$, $R^8$, and $R^9$ are each a straight chain or branched chain alkyl group having a total of 1 to 36 carbon atoms, a cycloalkyl group having a total of 3 to 36 carbon atoms, or an aryl group having a total of 6 to 36 carbon atoms; $R^4$ is a halogen atom, a straight chain or branched chain alkyl group having a total carbon number of 1 to 12, or a straight chain or branched chain alkoxy group having a total of 1 to 12 carbon atoms; k is an integer ranging from 1 to 4; m is an integer ranging from 0 to 5; and n and o are integers each ranging from 0 to 4, provided the sum of k and m is 6 or less.

13. The light-sensitive material according to claim 12, wherein $R^1$ to $R^9$ can have a substituent selected from the group consisting of a halogen atom, an alkyl group, an aryl group, and an alkoxy group, and an alkoxycarbonyl group, except for the case where $R^4$ is a halogen atom.

14. The light-sensitive material according to claim 12, wherein k in the formula (2) is 1 or 2.

15. The light-sensitive material according to claim 12, wherein n and o in the formula (3) are 0 or 1.

* * * * *